US007240885B1

(12) United States Patent
Sullivan

(10) Patent No.: US 7,240,885 B1
(45) Date of Patent: Jul. 10, 2007

(54) EMERGENCY VEHICLE SUPPORT KIT

(76) Inventor: James G. Sullivan, 10013 Norwood St., Rosemont, IL (US) 60018

( * ) Notice: Subject to any disclaimer, the term of this patent is extended or adjusted under 35 U.S.C. 154(b) by 152 days.

(21) Appl. No.: 10/786,981

(22) Filed: Feb. 25, 2004

Related U.S. Application Data

(63) Continuation-in-part of application No. 10/252,255, filed on Sep. 23, 2002, now Pat. No. 6,746,183.

(51) Int. Cl.
*A47F 5/00* (2006.01)
*E04G 25/00* (2006.01)
*F16M 13/00* (2006.01)

(52) U.S. Cl. ..... 248/354.1; 248/351; 248/352

(58) Field of Classification Search ..... 248/351, 248/352, 354.1, 354.5, 354.6, 122.1, 157; 403/150, 153, 154, 157, 161
See application file for complete search history.

(56) References Cited

U.S. PATENT DOCUMENTS 3,355,136 A * 11/1967 Staples ..... 248/352
5,402,595 A * 4/1995 Tamllos ..... 42/94
5,575,492 A * 11/1996 Stone ..... 280/475
6,158,705 A * 12/2000 Cudmore et al. ..... 248/354.1
6,450,472 B1 * 9/2002 Cook, Jr. ..... 248/551
6,776,383 B2 * 8/2004 Lanka ..... 248/352
6,863,253 B2 * 3/2005 Valentz et al. ..... 248/519
2004/0258460 A1 * 12/2004 Taylor ..... 403/79

* cited by examiner

*Primary Examiner*—Amy J. Sterling
(74) *Attorney, Agent, or Firm*—Adrienne B. Naumann, Esq.

(57) ABSTRACT

An improved emergency vehicle support kit comprises a cylinder and two pistons attached to form a telescoping device. When assembled, the telescoping device attaches to an improved vehicle support base plate by a swivel support base plate adapter. The support base plate also attaches to swivel support base plate adapter, and this adapter rotates approximately 340 degrees along the upper vehicle support base plate surface. With this swivel support base plate adapter, the operator can manually orient the telescoping device either vertically or at an angle. Knurled connecting collars comprise circular interior lips which prevent each first and second piston from inadvertently falling from the cylinder or the wider piston, as the case may be.

10 Claims, 6 Drawing Sheets

EMERGENCY VEHICLE SUPPORT KIT

This application is a continuation in part of U.S. patent application Ser. No. 10/252,255 filed Sep. 23, 2002, now U.S. Pat. No. 6,746,183.

My invention relates to a kit for support of a crashed motor vehicle or weakened structure in which trapped persons must be quickly rescued to save their lives. There is a telescoping device with a cylinder and pistons which extend for rigid supporting length. More particularly, this invention relates to a kit with a manually operated telescoping device, a support base plate and upper interchangeable attachments. The telescoping device inserts with the support base plate vertically or at an angle to prop a vehicle or damaged building. The distal attachments grasp or pierce a portion of the vehicle or building for a support point.

The first and second pistons connect to each other and the lowermost cylinder by knurled collars with interior circular lips. First and second pistons telescope from the lowermost cylinder and are specifically engineered for support of a crashed motor vehicle or weakened building structure in an emergency. The cylinder and the first piston comprise a knurled collar with an interior circular lip.

The second piston also comprises an uppermost distal universal connector. This universal connector interchangeably connects other kit attachments to the telescoping device at its distal second piston end. These other attachments grasp portions of the crashed vehicle or weakened building structure. My knurled circular connectors between the cylinder and first piston, and first and second pistons, ensure that the pistons do not fall from the cylinder or accidentally disassemble.

The prior art contains models of vehicle kits used in emergency situations. The Res-Q-Jack™ Vehicle stabilization comprises a primary jacking device and two companion jacks to create three dimensional stabilization points around an overturned vehicle's edge. The companion jacks consist of telescopic perforated steel tubes for height adjustment in two inch increments. Attached to the base plates area are a pair of two inch wide nylon straps, each with an aluminum cam buckle and metal hook.

When all Res-Q-Jack™ components are in place, the operator pulls on the strap to release the cam buckle, thereby tensioning the stabilization system. The inside straps of each companion can be joined to further resist torsion vehicle movement. The jacking device, consists of a 78-inch fixed length steel tube with a swivel base plate, two straps and cam buckles. The actual Res-Q-Jack™ unit slides onto this post and once in place is cranked up or down. The rolled metal lip of the Res-Q-Jack catches the vehicle's rocker channel edge.

The disadvantage of the Res-Q-Jack™ Vehicle stabilization kit is that the tubing's square cross-section is a weaker structure than that of circular cylinders and pistons. Furthermore, the base plate is a foot-like structure with less retentive features than my improved base plate, and there are no tethered pins.

Paratech Incorporated produces a vehicle stabilization unit with strut extensions made of aluminum alloy tubing. Each strut extension has a spring loaded locking pin to connect to a strut extension. It also comprises rigid aluminum structures such as base plugs of different lengths and is designed for low clearance use with a variety of base and end plates. Paratech, Incorporated also markets a tripod conversion kit which attaches to a rescue strut, and with extensions for tripod use as a jack stand and/or high support.

This kit is designed for trench rescue, building collapse and vehicle stabilization with its corresponding trench rescue struts.

Unlike my invention, the Paratech kit is intended primarily for trench shoring and converts to a vehicle support kit with one adapter. Furthermore, unlike Paratech my improved vehicle support kit comprises two extending pistons. My invention has two telescoping pistons, but it has eliminated Paratech's heavy cumbersome collars. Paratech Inc.'s Danish multi-brace comprises a support kit which is only for buildings. In contrast, my kit is equally well suited for both vehicles and buildings in an emergency situation. In addition Paratech's piston falls from the cylinder, unlike my kit pistons which are prevented from falling from the cylinder or intermediate piston by knurled rings, infra.

AiRSHORE International markets a ART Lite® vehicle stabilization kit comprising four adjustable stabilization struts with extensions and attachments. There is a locking aluminum support structure for vertical, horizontal and angled support for vehicles. The ART Lite kit has two extensions as well as a 15 degree swivel attachment within a base plate.

However, the AiRSHORE kit base plate does not have extending arms for three-point attachment with ratcheting straps. Neither does the AiRSHORE base plate comprise (i) small studs which grip or provide friction against the support surface; or (ii) apertures for driving stakes through the base plate and into the supporting surface such as grass. The AiRSHORE kit also comprises loose components which are easily misplaced during crisis. In contrast, my straight metal detent pins with compressible beads, infra, are tethered to the telescoping device and base plate, and are always available in an emergency.

To prevent the single piston from falling away from of the cylinder, the AiRSHORE device comprises a collar with T-handles which prevent loosening of the single piston. In contrast, my two telescoping pistons are prevented from falling from the cylinder or intermediate piston by knurled rings, infra. My knurled rings are much less cumbersome and have knurled surfaces for grasping with thick gloves. In addition, my novel knurled rings do not require T-handles to insure a tight grip of the piston, unlike the AiRSHORE device.

In addition, AiRSHORE does not have a universal adapter for interchangable distal end attachments, including those of prior art manufacturers. Without a universal adapter, the AIRSHORE device cannot use diverse prior art attachments to contact the vehicle or building. Instead, each AiRSHORE attachment has a rounded bottom surface which inserts within the most distal end of single piston of its vertical support component.

In contrast, my universal adapter inserts within the distal end of the distal second piston. It's upper end is shaped so other manufacturers' prior art attachments fit over the upper part of the universal adapter, and are attached thereto with a straight metal détente pin with a compressible bead. For example, compatible prior art attachments with my telescoping device include components of hydraulic rescue tools.

The CRUTCH vehicle stabilization system is positioned on the roof side of a rollover vehicle. A second CRUTCH is located along the undercarriage, opposite and across from the first unit. Used in pairs, each CRUTCH consists of steel tubing that adjusts from 48 inches length to a fully extended length of 76 inches. As the upper tube telescopes to the required length, it is pinned in place, and adjusting the length allows the operator to obtain the optimum angle of 75 degrees.

The upper end of each CRUTCH tubing accepts a two-headed accessory with a rod which fits into openings or corner areas. This two-headed accessory also comprises a flat insertion plate end which fits within the hood, trunk and fender seams of vehicles. Each CRUTCH has an attached base plate secured by a ratchet device, one inch-wide webbing and steel hooks. The metal hooks on the web attach to relatively stable lower points along the vehicle. The base plates are held together with ratchet straps.

Unlike my kit, the CRUTCH system comprises square metal tubing for its vertical support, which is structurally weaker than my round pistons and cylinder with thicker walls. In addition, the CRUTCH base plate is more of a metal foot similar to that of AiRSHORE supra, and the CRUTCH base plate does not have the substantial weight of my improved base plate.

RESCUE 42, INC. markets a kit known as a TeleCribbing™ Stabilization System with TC™ struts. This system is designed for extrication and light structural support during rescue or salvage. Telescoping sections interlock and are held in place by pins. The contact attachments rotate and position with a ratchet strap which pulls the TC™ strut bases toward each other. The TeleCribbing™ system comprises tabs which prevent telescoping sections from falling from each other.

However, because the vertical support section is square in cross-section, the vertical support cannot rotate, but instead must follow a channel within each telescoping section. The TeleCribbing™ base plate does not provide three-point ratcheting strap attachment as does my kit. Furthermore, this TeleCribbing™ system is not designed for support of heavy structures because it simply does not have the materials or structural strength. In contrast, my support kit is adaptable to both light support applications such as a damaged building, as well as motor vehicle accidents.

In contrast to all the above prior art, my improved emergency vehicle support kit comprises all the advantages of: (i) knurled rings with interior circular lips to prevent telescoping parts from falling from each other; (ii) a substantial base plate with additional structural features for strength and attachment of ratcheting straps; (iii) a universal piston adapter; and (iv) swivel support base plate adapter. The interior circular lip of each knurled ring engages the lower first piston end and/or the lower second piston end, as the case may be. Each corresponding interior circular lip prevents the first or second piston from exiting the cylinder distal end or distal first piston end respectively.

Furthermore, my kit operates manually and no pneumatic source of pressure or force is present. My kit also remains rust-free indefinitely because it is comprises only aluminum and stainless steel, thereby minimizing maintenance costs.

SUMMARY OF THE INVENTION

In the best mode and preferred embodiment of my improved emergency vehicle support kit, there is no pneumatic source for extension force of the telescoping device. Instead the operator manually extends the telescoping two pistons until he or she feels resistance from an opposing vehicle (or building) surface. In all embodiments, my invention includes first and second pistons with attached cylinder, a supporting vehicle base plate and a swivel base plate adapter.

The preferred embodiment and best mode also include attachments which lodge within, or grasp, a crashed motor vehicle and provide the supporting contact. In other embodiments, the kit includes attachment which contact a building in danger of collapse. Other embodiments comprise diverse upper endplate structures such prior art U-shaped end-plates with appropriate adapters. Other piston attachments for contacting a vehicle or building are also within the scope of my invention.

Another new feature of my shoring device is a reinforced support base plate. Studs on the base plate lower surface insert into a supporting surface for stabilization. Along the base plate top surface are two integral elevated base plate walls which contain a swivel base plate adapter in a swiveling position through an angle of approximately 140 degrees. Also along the top surface of my supporting base plate are numerous circular apertures. These circular apertures contain removable stakes if additional stabilization is necessary; the operator then drives the stakes into the supporting surface to immobilize the base plate.

Elevated base plate walls are engineered along their interior surfaces to enclose and attached my new swivel base plate adapter, infra when swivel base plate adapter rotates through approximately 130 degrees. In the preferred embodiment and best mode there are two aligned opposing apertures within the proximal edges of the two opposing elevated base plate walls. During operation, a metal detent ring pin with a compressible bead inserts within these two aligned opposing apertures. This pin attaches to a ratcheting cord or strap which can also incorporate an S-hook or other metal connecting device. A metal detent ring pin with a compressible bead then stabilizes the base plate by opposing force from the building or vehicle through the cord or strap, in a manner well known in this particular industry.

My swivel base plate adapter is an attachment into which the lowermost end of the cylinder inserts, either perpendicular or at an angle to, the vehicle support base plate upper surface. A swivel base plate adapter sits within the elevated base plate walls and is attached with a second metal detent ring pin through a second set of opposing aligned mid-line apertures. There is one such opposing aperture within each elevated base plate wall.

With the swivel base plate adapter attached within the vehicle support base plate by second metal detent pin, the rescuer inserts the lowermost proximal cylinder end within the swivel base plate adapter. He or she then secures the lowermost proximal cylinder end by using a third straight metal detent ring pin with a compressible bead. Once inserted, the telescoping device attaches to the swivel base plate adapter (1) at an angle; or (2) perpendicular to supporting surface 8.

The rescuer next inserts a straight metal detent pin with compressible bead at the appropriate pre-selected protruding piston, for contact along the downed vehicle or building. A second operator then attaches a ratcheting strap to the support base plate and vehicle. He or she ratchets the vehicle and base plate together prior to manually releasing the telescoping device which now supports the vehicle or building wall.

With the telescoping cylinder and pistons of the kit, engagement with an inner circular lip of each of two outer knurled rings occurs automatically. Each inner circular lip prevents each piston from falling from the cylinder. My invention also comprises one cylinder end plug at the lower proximal end of cylinder. This cylinder end plug is hollow at its proximal end for attachment to swivel base plate adapter. The first and second piston proximal end plugs are solid metal. Each piston end plug catches its corresponding knurled ring interior circular lip, thereby preventing each piston from disengaging beyond its knurled ring.

First and second pistons each have predetermined axial longitudinal lengths, as well as diameters and wall thickness. First and second pistons preferably are approximately 35 (thirty-five) inches and 33 (thirty-three) inches in length respectively. However, other lengths are also within the scope of my improved emergency vehicle support kit. The uppermost second piston, which has a smaller diameter than first intermediate piston (and the intermediate first piston has a smaller diameter than the cylinder) reversibly slides into and/or protrudes from, the first piston distal end.

Both first piston and second piston comprise linearly aligned opposing apertures along their respectively axial longitudinal lengths. At each set of opposing apertures a metal detent ring pin inserts to attach the first piston to second intermediate piston at different aperture intervals along the second piston. The specific predetermined two opposing apertures of inserted (male) second piston and first receiving (female) piston and thereby secured by the metal detent ring pin through all four aligned apertures. The pre-selected length of the second piston which protrudes from the first piston distal end depends upon the required extended length for a particular application.

The cylinder distal end also comprises two opposing sets of aligned cylinder apertures immediately below the attached knurled metal connector ring. The proximal end of the first piston is congruently aligned with two opposing cylinder apertures. The straight metal detent ring pin with a compressible bead then inserts through all six apertures to maintain a totally retracted position.

Accordingly, it is a purpose of the present invention to provide a swivel support base plate which rotates through approximately 130 degrees.

Another purpose of the present invention is to provide a telescoping second piston which is intended to support a heavy weight from a vehicle or building.

Another purpose of the present invention is to provide knurled rings which prevent the first piston and second piston respectively from falling from the distal ends of the cylinder and first piston respectively.

Another purpose of the present invention is to provide knurled rings which provide an improved gripping surface for rescuers wearing thick gloves.

Another purpose of the present invention is to provide a swivel adapter which need not be removed and reinserted for a vertical or pre-selected angled position.

Another purpose of my invention is to provide a distal universal adapter which can attach to my improved attachments, as well as prior art attachments, to the distal end of the second piston.

These purposes and other features of the preferred embodiment and best mode are set forth in the detailed description of the invention and drawings, infra.

DETAILED DESCRIPTION OF THE PREFERRED EMBODIMENT AND BEST MODE OF THE INVENTION

Introduction

Figure 1:
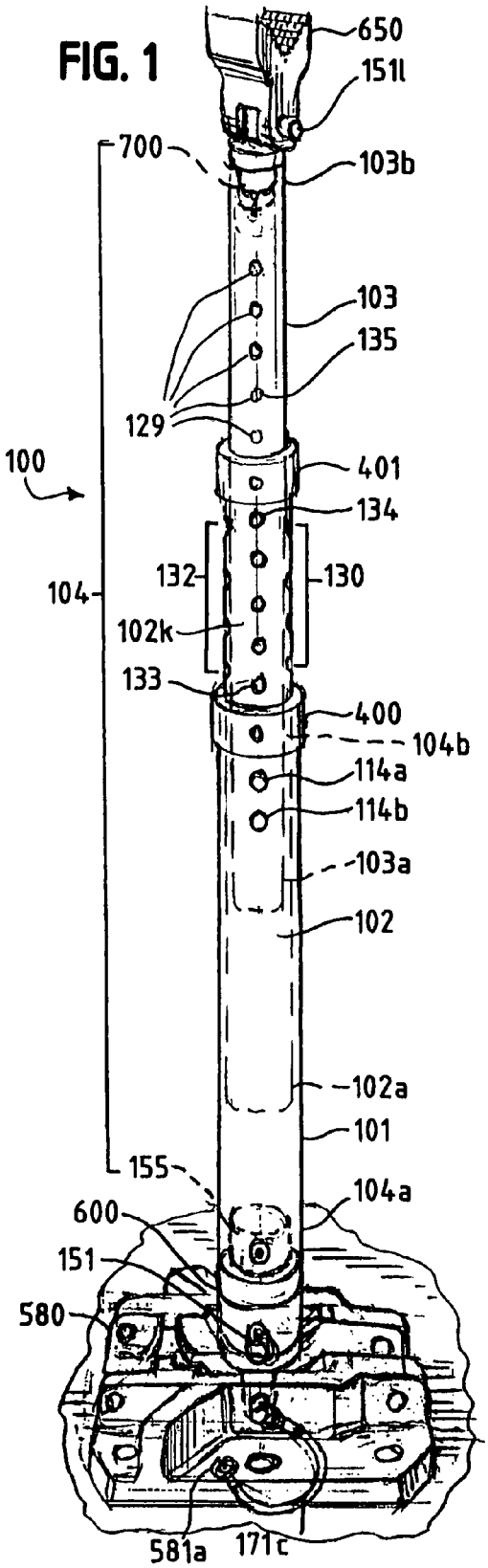
FIG. 1 illustrates an assembled improved emergency vehicle support kit with a double-blade attachment.

Referring to FIG. 1 of the preferred embodiment, my improved emergency vehicle support kit 100 comprises a telescoping device 104. Telescoping device 104 comprises a lower cylinder 101, an intermediate first piston 102 and uppermost second piston 103. There are also associated connectors, attachments and a vehicle support base plate 580. Vehicle support kit 100 is particularly suited for support of overturned vehicles during rescue, and kit 100 only requires manual force for operation.

Telescoping device 104 is preferably approximately (i) one hundred and five inches in longitudinal axial length in its maximum extended configuration; and approximately (ii) thirty-seven and one-half inches at its maximum collapsed and retracted configuration (in which only cylinder 101 is visible). When fully extended and standing within vehicle support base plate 580, infra, telescoping device 104 exhibits a minimum failure load of 14.2 kips (where one kip=1,000 pounds) with overall buckling. When only intermediate first piston 102 is extended, second piston 103 remains retracted, and telescoping device 104 stands within vehicle support base plate 580, the minimum load at which fracture of the universal adapter 700, infra, occurs is 40.3 kips.

However, other diameters and lengths are also within the scope of my invention.

Cylinder 101

Figure 2:
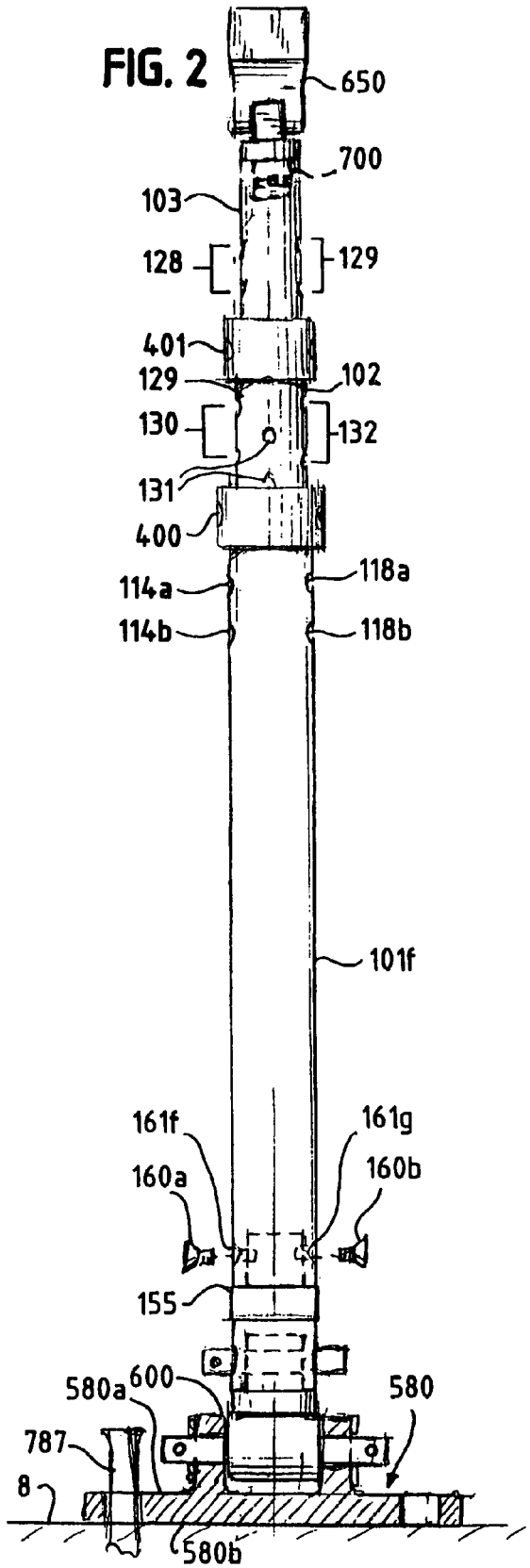
FIG. 2 illustrates a partially collapsed lateral view of the assembled improved emergency vehicle support kit of FIG. 1.

Referring now to FIGS. 1 and 2, cylinder 101 is the bottom proximal component of telescoping device 104 and comprises a cylindrical wall 101*f*. Cylinder 101 is preferably approximately thirty-seven and one-half inches in length and approximately three inches in interior diameter. Cylinder wall 101*f* is preferably approximately one-quarter inch thick. Cylinder 101 has a proximal cylinder end 104*a* and a distal cylinder end 104*b*.

Cylinder 101 also comprises first and second opposing distal cylinder pin apertures 114*a*, 114*b* respectively, and third and fourth distal cylinder pin apertures 118*a*, 118*b* respectively. Linearly aligned distal first and second cylinder pin apertures 114*a*, 114*b* are approximately 180 degrees (along cylinder wall 101*f*) from linearly aligned third and fourth cylinder pin apertures 118*a*, 118*b*.

Linearly aligned first and second distal cylinder pin apertures 114*a*, 114*ab* are approximately one and one-quarter inches apart from each other, as are linearly aligned distal third and fourth cylinder apertures 118*a*, 118*b* from each other. Each distal first and third distal cylinder pin aperture 114*a*, 118*a* respectively is closest to distal cylinder end 104*b*. Each first and third distal cylinder pin aperture 114*a*, 118*a* respectively is approximately two and one-quarter inches from distal cylinder end 104*b*.

Still referring to FIG. 2, at proximal cylinder end 104*a* are first and second opposing cylinder cap screw apertures 161*f*,161*g* respectively. Each cylinder cap screw aperture 161*f*, 161*g* is approximately 180 degrees from the other along cylindrical wall 101*f*. Cylinder cap screw apertures 161*f*,161*g* congruently align with cylinder end plug screw apertures 161*a*,161*b* to attach cylinder end plug 155 to proximal cylinder end 104*a*, infra.

Proximal Cylinder End Plug 155

Figure 3:
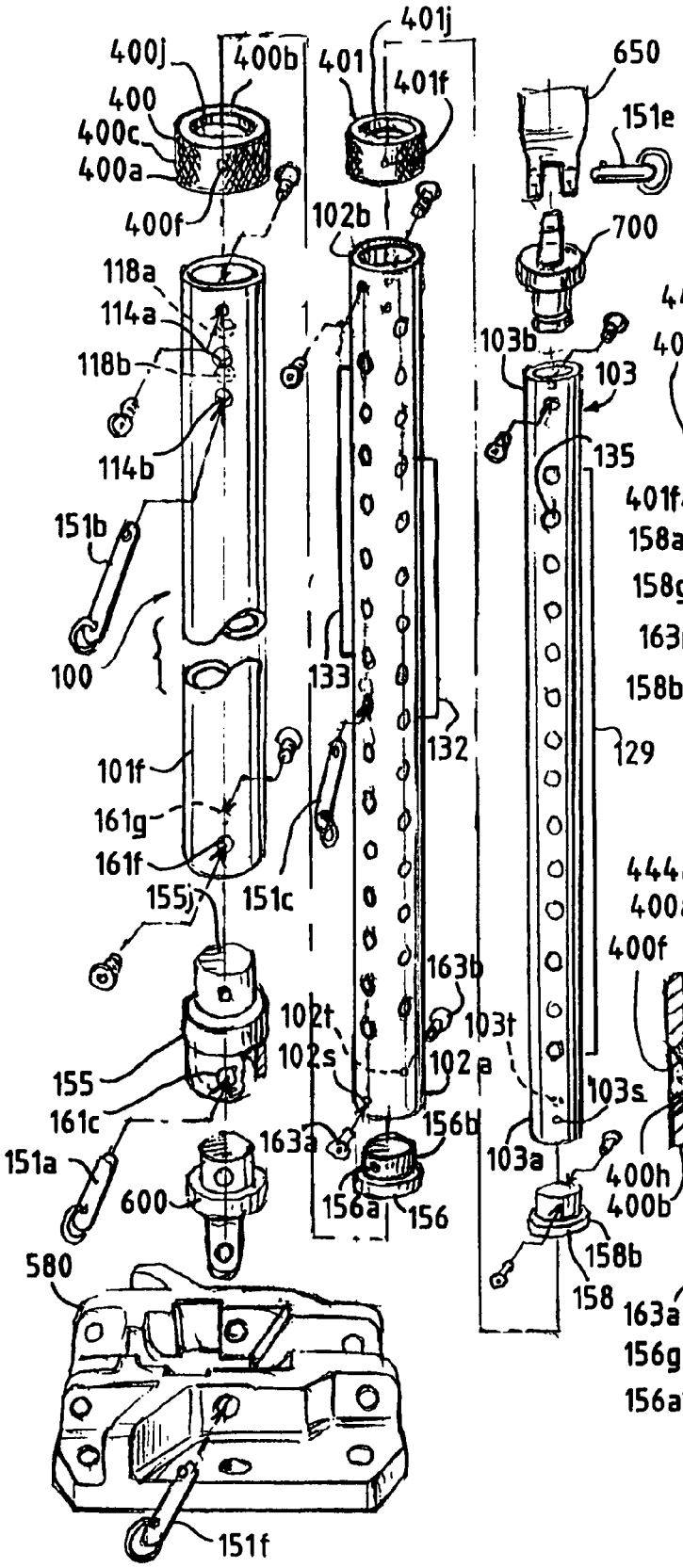
FIG. 3 illustrates an exploded view of the improved emergency vehicle support kit of FIG. 1.
Figure 14:
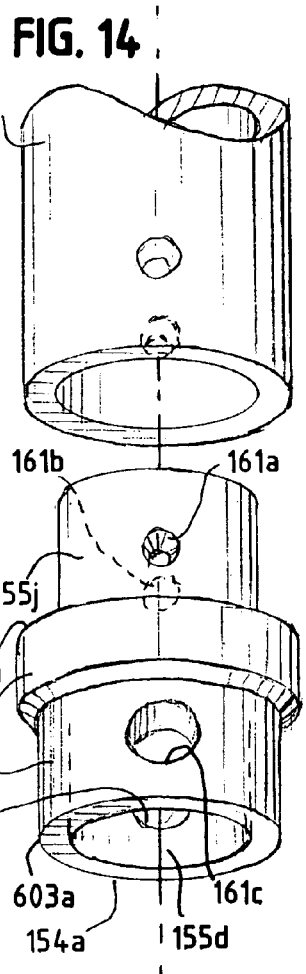
FIG. 14 illustrates an isolated exploded view of a cylinder segment into which a cylinder end plug inserts, and with the cylinder end plug inserting over the swivel base plate adapter.

Referring to FIGS. 2, 3 and 14, in the preferred embodiment and best mode proximal cylinder end plug 155 attaches to lowermost cylinder proximal end 104*a* by (i) first and second stainless steel first and second button-head socket cap screws 160*a*, 160*b* respectively through (ii) opposing first and second cylinder end plug apertures 161*a*, 161*b* respectively. Stainless steel button-head socket cap screws 160*a*, 160*b* oppose each other at approximately 180 degrees along cylinder wall 101*f*. Proximal cylinder end plug 155 abuts proximal cylinder end 104*a* by circular end plug ledge 155*a*. Inserted first and second stainless steel button head socket cap screws 160*a*, 160*b* are each approximately one-half inch from cylinder proximal end 104*a*.

Referring to FIG. 14, the proximal inner diameter of cylinder end plug interior 155*d* at proximal cylinder plug end 154*a* is approximately two and one-quarter inches. Proximal cylinder end plug interior 155*d* is designed to reversibly receive swivel base plate adapter 600, infra. Proximal cylinder plug end wall 155*f* is preferably approximately one-half inch in thickness at proximal cylinder plug end 154*a*. Cylinder end plug 155 comprises a intermediate positioned circular end plug ledge 155*a* which is flush with cylinder wall 101*f*.

Still referring to FIG. 14, proximal cylinder end plug interior 155*d* is approximately two inches in depth and contains cylinder end plug apertures 161*c*, 161*d*. Cylinder end plug apertures 161*c*, 161*d* oppose each other at approximately 180 degrees along cylinder wall 101*f*. Each cylinder end plug aperture 161*c*, 161*d* is approximately five-eighths inch in diameter. Cylinder end plug pin apertures 161*c*, 161*d* are aligned, so first straight metal detent ring pin with a compressible bead 151*a* inserts within both cylinder end plug pin apertures 161*c*, 161*d*, as well as congruently aligned upper swivel support plate adapter apertures 601*a*, 601*b*, infra.

Solid metal upper distal end plug end 155*j* is approximately two inches in cylindrical height. Distal end plug end 155*j* inserts within proximal cylinder end 104*a* so cylinder end plug ledge 155*a* is flush with cylinder wall 101*f*. Cylinder end plug ledge 155*a* is approximately one inch in cylindrical height and one-quarter inch in thickness at distal ledge end 155*aa*.

Intermediate First Piston 102

Referring initially to FIG. 1 of the preferred embodiment, intermediate first piston 102 is cylindrical in shape. Piston 102 comprises a first piston cylindrical wall 102*k* which is approximately (i) thirty-five inches in longitudinal axial length, and (ii) two and five-eighths inches in inner diameter. However, other lengths and diameters are also within the scope of my invention. First cylindrical piston wall 102*k* is approximately one-quarter inch in thickness. Proximal first piston 102 is narrower in diameter than cylinder 101, and first piston 102 reversibly inserts into distal cylinder end 104*b*.

Referring to FIG. 3 of the preferred embodiment, proximal first piston 102 has a proximal first piston end 102*a* and a distal first piston end 102*b*. Intermediate proximal first piston 102 also comprises four linearly aligned parallel sets 130, 131,132, 133 of individual first piston apertures 134. First piston apertures 134 are each preferably approximately three-quarters inch in diameter. First piston aperture sets 130, 131, 132, 133 are linearly aligned along the axial longitudinal axis of first piston 102.

Still referring to FIGS. 1, 2 and 3, each first piston aperture set 130, 131, 132, 133 is preferably approximately 90 degrees from each adjacent aligned set. First piston apertures 134 within each set 130, 131, 132, 133 are also preferably staggered in alternating alignment from adjacent aperture sets 130, 131, 132, 133. Opposing first piston aperture sets 130/132 and 131/133 are approximately 180 degrees from each other along first piston wall 102*k*. Second straight metal detent ring pin with compressible bead 151*b* inserts simultaneously through two opposing first piston apertures of sets 130/132 or 131/133, as well as congruently aligned cylinder apertures 114*a*, 118*a* or 114*b*, 118*b*.

Figure 4:
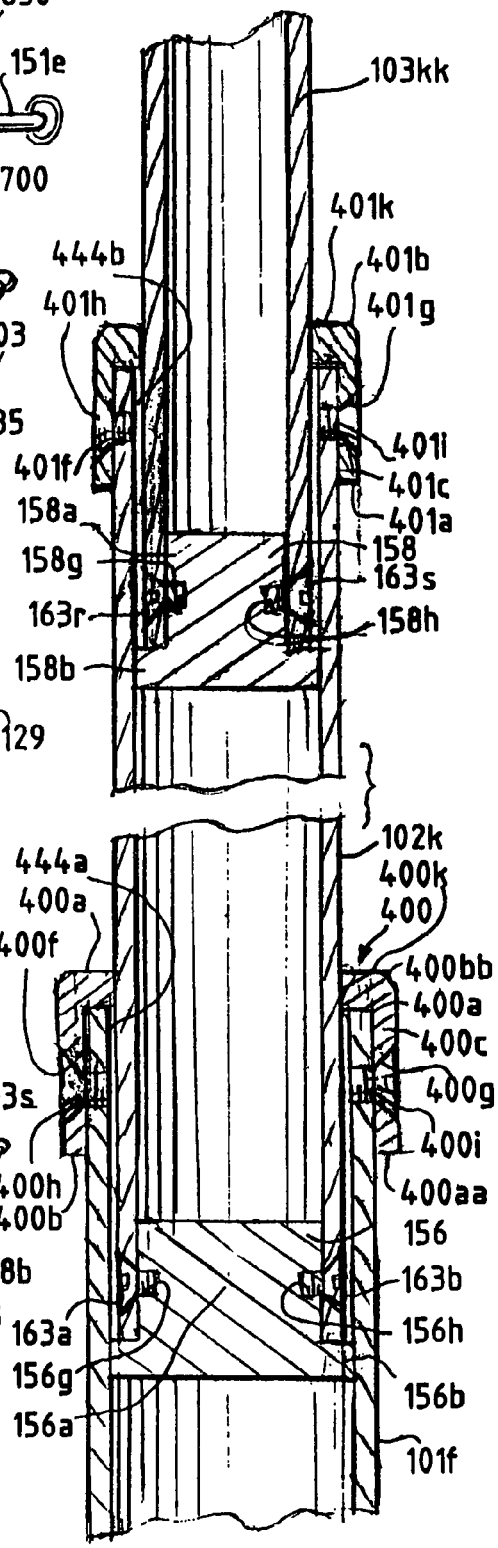
FIG. 4 illustrates an isolated longitudinal cross-sectional view of a segment of the telescoping device with knurled rings, first piston end plug and second piston end plug.

Each first piston aperture 134 within a linearly aligned first piston aperture set (such as set 132) is approximately one and one-quarter inches from adjacent first piston aperture 134 within that same set 132. Each first piston aperture set 130, 131, 132, 133 preferably comprises fifteen linearly aligned first piston apertures 134. However, adjacent first piston aperture sets 130/131 or 132/133 are staggered so first piston apertures 134 of one set are positioned midway between apertures of adjacent sets along first piston wall 102*k*. Four linearly aligned first piston aperture sets 130, 131, 132,133 are preferred, but other numbers of linearly aligned sets are also within the scope of my invention. As seen in FIG. 4, as first piston 102 inserts into cylinder 101 there is a resulting continuous longitudinal space 444*a* between cylinder wall 104*f* and first piston wall 102*k*. This space 444*a* is approximately one-sixteenth of an inch in width. First and second piston end plug apertures 102*s*, 102*t* respectively each contain one screw 163*a*, 163*b* respectively, which attach end plug 156 to first piston proximal end 102*a*.

Proximal First Piston End Plug 156

As best seen in FIGS. 3 and 4, proximal first piston end 102*a* is capped by proximal first piston end plug 156.

Proximal first piston end plug 156 comprises a solid metal first piston cylindrical end 156*a* which fits within proximal first piston end 102*a*. Proximal first piston end plug 156 also comprises integral circular flat first piston cap 156*b*. Proximal first piston end plug cylindrical end 156*a* is approximately one and one-half inches in cylindrical height and two and one-quarter inches in diameter.

Circular flat first piston cap 156*b* is approximately three inches in diameter and one-half inch in thickness. First piston cylindrical end 156*a* contains first and second opposing first piston end plug apertures 156*g*, 156*h* respectively. Apertures 156*g*, 156*h* respectively receive third and fourth stainless steel flat-head socket cap screws 163*a*, 163*b* respectively, for attachment of proximal first piston end plug 156 to proximal first piston end 102*a*.

Uppermost Distal Second Piston 103

Referring to FIGS. 1, 2, 3 and 4 of the preferred embodiment, uppermost distal second piston 103 comprises a continuous cylindrical second piston wall 103*kk*. Cylindrical second piston wall 103*kk* is approximately thirty-three inches in axial longitudinal length, and approximately one and three-quarters inches in inner diameter (i.e, from inner cylindrical wall surface 103*d*). However, other lengths and diameters are also within the scope of my invention, as long as distal uppermost second piston 103 can totally insert within first piston 102.

Cylindrical second piston wall 103*kk* is approximately one-quarter inch in thickness. Uppermost distal second piston 103 is narrower in diameter than first piston 102, into which second piston 103 reversibly inserts by sliding. Uppermost distal second piston 103 has a proximal second piston end 103*a* and a distal second piston end 103*b*. Proximal piston end 103*a* comprises two opposing apertures 103*s*, 1035 for attachment with screws 163*r*, 163*s* through end plug 158.

Referring to FIGS. 1 and 2, along its longitudinal axis distal second piston 103 comprises two linearly aligned parallel sets of first and second opposing second piston aperture sets 128,129 respectively. Each second piston aperture set 128, 129 comprises individual second piston apertures 135. Second piston apertures 135 are each approximately three-quarters inch in diameter. Each second piston aperture set 128,129 is preferably approximately 180 degrees from its opposing aligned second piston set 129. However, other numbers of linearly aligned piston aperture sets are also within the scope of my invention.

Still referring to FIG. 3, each second piston aperture 135 is approximately one and one-quarter inches from each adjacent second piston aperture 135 within its respective second piston apertures set 128, 129. Opposing second piston apertures 135 align so third straight metal detent ring pin with compressible bead 151*c* inserts through (i) two opposing second piston apertures 135 of each set 128, 129 simultaneously, with (ii) congruently aligned opposing first piston apertures 134 from opposing sets 133/131 or 130/132 as the case may be.

As seen in FIG. 4, when uppermost second piston 103 completely inserts within first piston 102, there is a resulting continuous longitudinal space 444*b* of approximately one-sixteenth inch between piston wall 103*kk* and first piston wall 102*k*. This space facilitates manual removal and insertion of second piston 103 within wider first piston 102.

Proximal Second Piston End Plug 158

Still referring to FIGS. 3 and 4, proximal second piston end 103*a* is capped by solid metal proximal second piston end plug 158. Proximal second piston end plug 158 comprises a solid metal second piston end plug cylindrical end 158*a*, and end 158*a* fits within proximal second piston end 103*a*. Proximal second piston end plug 158 also comprises integral circular flat second piston cap 158*b*. Second piston end plug cylindrical end 158*a* is approximately one and one-quarter inches in cylindrical height, and one and five-eighths inches in diameter.

Circular flat second piston cap 158*b* is approximately two and one-quarter inches in diameter and one-half inch in thickness. Second piston end plug cylindrical end 158*a* contains first and second opposing second piston end plug apertures 158*g*, 158*h* respectively. Second piston end plug apertures 158*g*, 158*h* oppose each other at approximately 180 degrees and congruently align with apertures 103*s*, 103*t* respectively. Second piston end plug apertures 158*g*, 158*h* respectively receive first and second stainless steel flat-head socket cap screws 163*r*, 163*s* respectively, for attachment of proximal second piston end plug 158 to proximal second piston end 103*a*. When so attached, proximal second piston end plug 158 is flush with second piston cylindrical wall 102*kk* at circular second piston cap 158*b*. First and second piston end plugs 156, 158 respectively prevent distortion of proximal ends 102*a*,103*a*.

Knurled Cylinder Ring 400

Referring now to FIGS. 1, 2, 3, 4 and 15, attached to cylinder distal end 101*b* is first knurled cylinder ring 400. First knurled cylinder ring 400 is approximately four inches in outer diameter, three and one-half inches in inner diameter at proximal knurled edge 400*aa*, three inches in inner diameter at distal knurled edge 400*bb*, and two inches in height of cylindrical knurled wall 400*c*. As seen in FIG. 4, first knurled cylinder ring 400 also comprises (i) an upper distal knurled wall thickness 400*a* of approximately five-eighths inch; and (ii) a lower proximal knurled wall thickness 400*b* of one-quarter inch.

Figure 15:
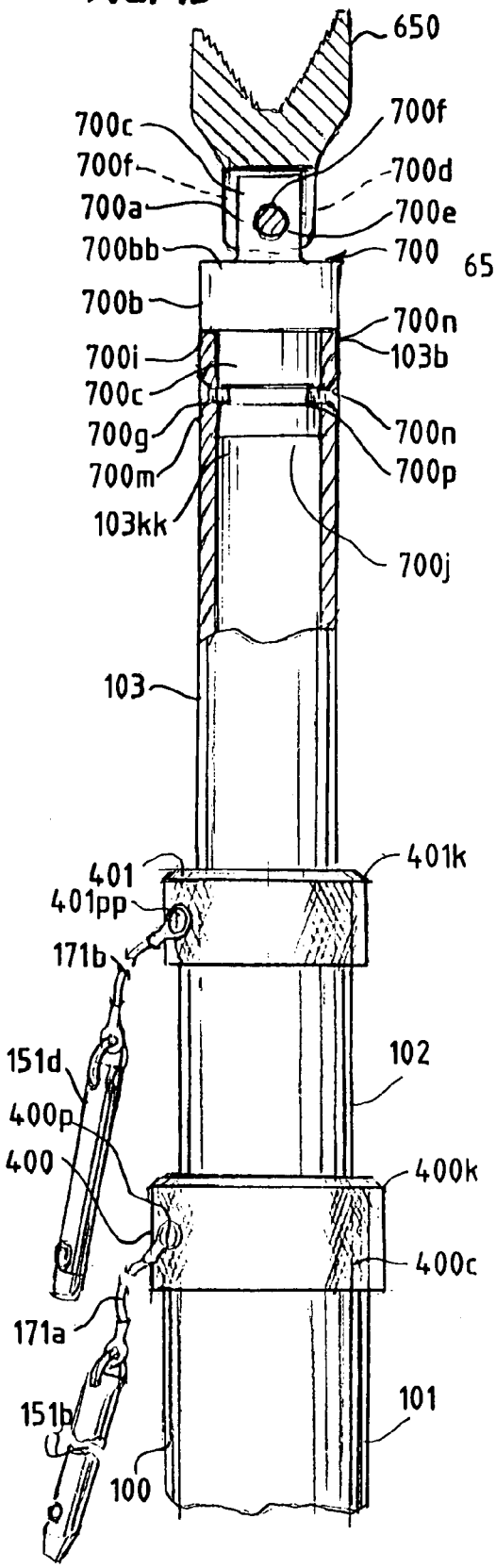
FIG. 15 illustrates a lateral view of a doubled bladed attachment inserted over a universal adapter, and the universal adapter inserted within a distal second piston

Cylindrical knurled wall 400*c* comprises first and second knurled apertures 400*f*, 400*g* respectively, which oppose each other at approximately 180 degrees. Each knurled aperture 400*f*, 400*g* receives a corresponding first and second knurled stainless steel flat-head socket cap screw 400*h*, 400*i* respectively to attach first knurled cylinder ring 400 to distal cylinder end 104*b*. As seen in FIG. 15, at approximately 90 degrees to both knurled apertures 400*h*, 400*i* is knurled round head screw 400*p*. Knurled screw 400*p* connects metal lanyard 171*a* to second straight metal detent ring pin with compressible bead 151*b*. Second straight metal detent ring pin with compressible bead 151*b* simultaneously inserts through congruently aligned cylinder apertures 114*a*, 118*a* or 114*b*, 118*b* and first piston apertures 131/133 or 130/132 as the case may be.

As seen in FIGS. 4 and 15, integral with distal knurled edge 400*bb* and knurled interior surface 400*j* of cylindrical knurled wall 400*c* is interior circular lip 400*k*. Interior circular lip 400*k* is approximately three-eighths inch in width and one-half inch in height. Cylinder knurled ring 400 slides onto cylinder distal end 104*b* until there is abutting contact of interior circular lip 400*k* with cylinder distal end 104*b*. Cylinder knurled ring 400 prevents first piston 102 from disengaging with distal cylinder end 104*b*.

Knurled First Piston Ring 401

Still referring to FIGS. 1, 4 and 15, in the preferred embodiment first piston knurled ring 401 is identical in structure and function, and material composition to knurled cylinder ring 400. First piston knurled ring 401 attaches to first piston distal end 102*b*. Knurled first piston connector 401 is approximately three and five-eighths inches in outer diameter; three inches in inner diameter at proximal knurled edge 401*aa*; two and three-eighths in diameter at distal knurled edge 401*bb*; and one and one-half inches in height of first piston cylindrical knurled wall 401*c*. First piston knurled ring 401 also comprises:

(i) a proximal first piston knurled wall thickness 401*a* of approximately three-eighths inch; and (ii) a distal first piston knurled wall thickness 401*b* of approximately five-eighths inch.

First piston knurled ring 401 comprises first and second knurled piston apertures 401*f*, 401*g* respectively, which oppose each other at approximately 180 degrees. Each knurled first piston aperture 401*f*, 401*g* receives a corresponding first and second knurled stainless steel button-head cap screws 401*h*, 401*i* respectively. Screws 401*h*, 401*i* attach first piston knurled ring 401 to distal first piston end 102*b*. At approximately 90 degrees to both knurled first piston apertures 401*h*, 401*i* is round head first piston screw 401*pp*. Screw 401*pp* connects metal lanyard 171*b* to fourth straight metal detent ring pin with compressible bead 151*c*. Fourth straight metal detent ring pin with compressible bead 151*c* simultaneously inserts within congruently aligned first piston pin apertures 134 and second piston opposing pin apertures 135 within their appropriate sets.

Integral to distal wall interior 401*j* of knurled first piston wall 401*c* is interior circular lip 401*k*. Interior circular lip 401*k* is approximately three-eighths inch in width and one-half inch in longitudinal length. First piston knurled ring 401 slides over and downward upon upper first piston distal end 102*b* until there is abutting contact between interior circular lip 401*k* and first piston distal end 102*b*.

Universal Attachment Adapter 700

Referring to FIGS. 1, 2, 3 and 15, at uppermost distal second piston end 103*b* is universal attachment adapter 700. Universal attachment adapter 700 comprises an upper universal aperture end 700*a*, an integral intermediate circular adapter plate 700*b*, and an integral grooved universal cylindrical bottom 700*c*. Universal attachment adapter 700 is approximately four and five-eighths inches in total height.

Upper universal aperture end 700*a* is attached to upper universal plate surface 700*bb*, and upper universal aperture end 700*a* is approximately rectangular in longitudinal cross-section. Opposing first and second universal rectangular sides 700*c*, 700*d* respectively contain continuous opposing first and second universal apertures 700*e*, 700*f*. Universal adapter apertures 700*e*, 700*f* form a continuous channel 700*g* through upper universal aperture end 700*a* for insertion of fifth straight metal detent ring pin with compressible bead 151*e*. Preferably upper universal aperture end 700*a* is approximately one and one-half inches in width, two inches in height, and one and one-quarter inch in depth.

Still referring to FIG. 15, integral intermediate universal circular plate 700*b* is approximately two and one-half inches in diameter and approximately five-eighths inch in thickness. Universal circular plate 700*b* abuts uppermost distal second piston end 103*a* with an abutting universal ledge 700*i* of approximately three-eighths of an inch in width. Integral grooved universal cylindrical bottom 700*c* is approximately (i) one and three-quarters inches in diameter; and (ii) one and seven-eighths inches in height.

Approximately three-sixteenths inch from universal cylindrical bottom surface 700*j* is universal circular groove 700*p*. Universal circular groove 700*p* follows the circumference of lower grooved cylindrical bottom 700*c* at this three-sixteenths inch increment. Universal circular groove 700*p* is approximately one-quarter inch in width and one-eighth inch in depth.

Lower grooved universal cylindrical bottom 700*c* inserts into uppermost distal second piston end 103*b* until plate abutting ledge 700*i* contacts piston end 103*b*. Universal circular groove 700*p* stabilizes universal attachment adapter 700 with first and second opposing universal set screws 700*m*, 700*n*. Universal set screws 700*m*, 700*n* protrude interiorly through second piston wall 103*kk* and tightly abut grooved universal cylindrical bottom 700*c* within universal circular groove 700*p*. Set screws 700*m*, 700*n* protrude into and lodge tightly within circular groove 700*p* at approximately 180 degrees from each other.

Attachments to Universal Attachment Adapter 700

Double-Bladed Attachment 650

Referring now to FIGS. 1, 2, 3, 15 and 16, universal attachment adapter 700 attaches double-blade attachment 650 at uppermost second piston distal end 103*b*. Double-blade attachment 650 is approximately three inches in width 650*aa*; three and five-eighths inches in maximum height 650*bb*; and one and one-half inches in depth 650*cc* at double-bladed base 650*cc*.

Double-blade base 650*p* comprises a first blade leg 650*q* and a second blade leg 650*r*. Each blade leg 650*q*, 650*r* respectively contains a corresponding first and second round blade leg aperture 650*s*, 650*t* respectively. When blade leg apertures 650*s*, 650*t* congruently align with and over universal adapter apertures 700*e*, 700*f*, fifth straight metal detent ring pin with compressible bead 151*e* simultaneously inserts through all four apertures. Double-blade attachment 650 is thereby attached to distal second piston end 103*b*, when placed over upper adapter rectangular end 700*a*. When so attached, blade attachment legs 650*q*, 650*r* rest upon universal circular adapter plate 700*b*.

Figure 16:
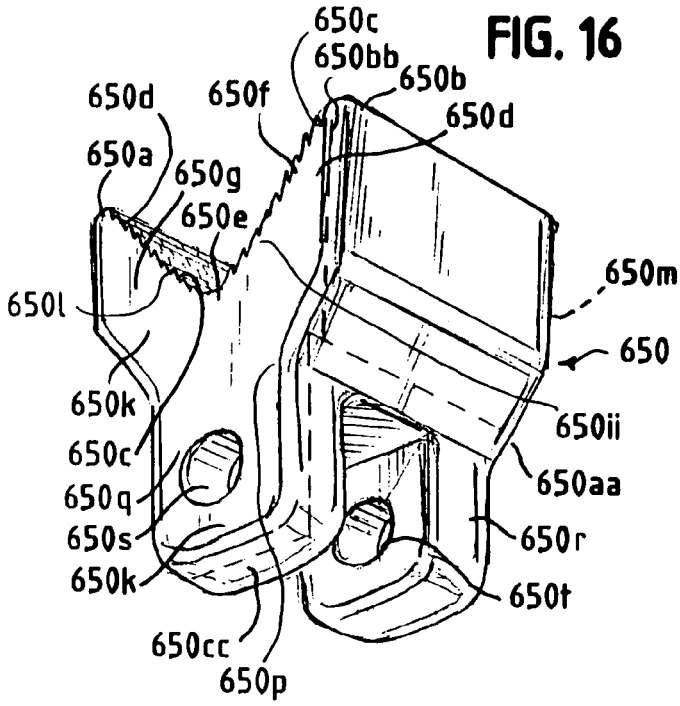
FIG. 16 illustrates an isolated close-up partial perspective view of a double-blade attachment.

Still referring to FIG. 16, double-blade attachment 650 has first and second solid metal blade ends 650*a*, 650*b* respectively. Blade edges 650*a*, 650*b* are approximately triangular in cross-section until double-blade longitudinal sides 650*k*, 650*m* partially converge towards double-blade base 650*p*. Each first and second uppermost blade edge 650*c*, 650*d* of each first and second metal blade 650*a*, 650*b* respectively, bevels downward towards interior flat blade segment 650*e*.

Interior flat bade segment 650*e* is co-extensive and continuous with uppermost blade edges 650*c*, 650*d*. Each uppermost blade edge 650*c*, 650*d* is continuous with first and second sloping surface 650*f*, 650*g* respectively, which slopes to interior flat segment 650*e*. Each sloping surface 650*f*, 650*g* comprises first and second grids 650*i*, 650*ii* respectively. Each grid pattern 650*i*, 650*ii* comprises numerous small parallel attachment projections which are rectangular in cross-section. Each first and second longitudinal opposing sides 650*k*, 650*m* respectively is flat and each longitudinal side 650*k*, 650*m* forms a "rabbit's head" profile which is continuous with each first and second double-blade leg 650*q*, 650*r* respectively. Double-blade attachment 650 is specially engineered to grip metal ledges and other elevations and protrusions along crashed motor vehicles.

Conical Attachment 660

Figure 17:
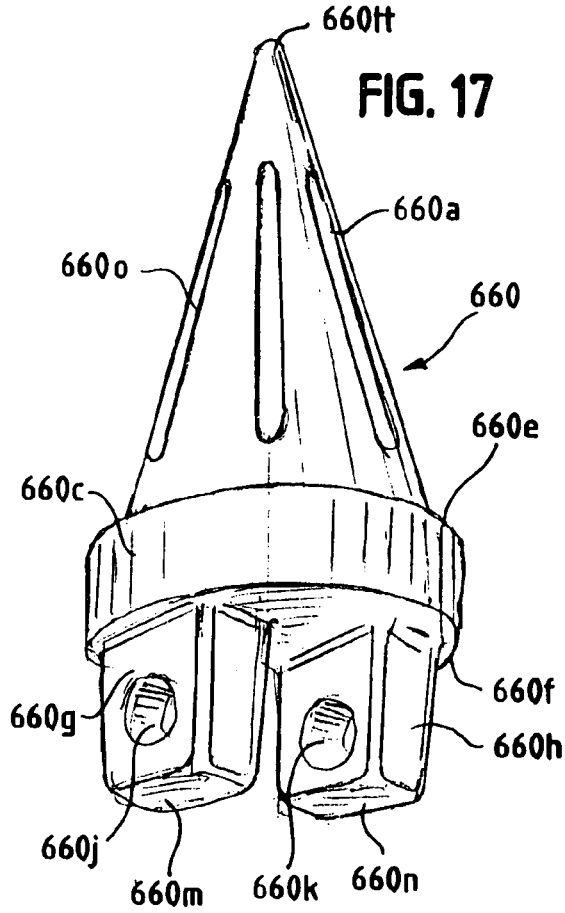
FIG. 17 illustrates a close-up isolated partial perspective view of a concial attachment.

Referring now to FIG. 17, also attachable to second piston universal adapter 700 is conical attachment 660. Conical attachment 660 comprises an upper distal cone 660*a*, and upper distal cone 660*a* is integrally attached (at its broadest base) to conical solid metal ring 660*c* at conical ring upper surface 660*e*. Upper distal cone 660*a* comprises cone grooves 660*o*. Cone grooves 660*o* extend from conical ring upper surface 660*e*, and grooves 660*o* terminate approximately half-way along upper distal cone 660*a*. Conical attachment 660 is approximately 7.0 (seven) inches in height and approximately 3.0 (three) inches in diameter at solid conical ring bottom surface 660*f*.

Integrally attached to lower surface 660*f* of conical sold metal ring 660*c* are first and second opposing conical legs 660*g*, 660*h* respectively. Conical legs 660*g*, 660*h* are each approximately one and three-quarters inches in longitudinal length at lower conical ring surface 660*f*. Each conical leg 660*g*, 660*h* is also approximately three-quarters inch in maximum thickness along rounded bottom conical edges 660*m*, 660*n* respectively; and each conical leg 660*g*, 660*h* is approximately three-quarters inch in width. Each conical leg 660*g*, 660*h* is parallel to the other. Each first and second conical leg 660*g*, 660*h* comprises a first and second conical aperture 660*j*, 660*k* respectively. Conical apertures 660*j*, 660*k* align with each other so fifth straight metal détente ring pin with compressible bead 151*e* inserts within both apertures 660*j*,660*k* simultaneously.

First and second conical apertures 660*j*, 660*k* respectively congruently align exterior to, and with, second piston universal adapter apertures 700*e*, 700*f* respectively. Conical attachment 660 slide over and down universal adapter 700 until conical apertures 660*j*, 660*k* congruently align with universal adapter apertures 700*e*, 700*f*. In this alignment, fifth straight metal détente ring pin with compressible bead 151*e* inserts through all four apertures 600*j*, 660*k*, 700*e*, 700*f* simultaneously. In this manner, fifth straight metal detent ring pin 151*e* attaches conical connector 660 (which slides downward over universal adapter 700) to uppermost distal second piston end 103*b*.

Conical attachment 660 is best suited for insertion into a damaged vehicle to provide a contract point for telescoping device 104. Conical attachment 660 also provides safety for the operator, who initially inserts conical attachment 660 into a leverage position while remaining at a safe distance from vehicle 900 or a building.

Vehicle Support Base Plate 580

Referring now to FIGS. 1, 2, 3 and 5, vehicle support base plate 580, combined with swivel base plate adapter 600 infra, supports vehicle telescoping component 104, either vertically or at an angle to support surface 8. Vehicle support base plate 580 is custom-made by Meskan Foundry and is made of 356-T6 aluminum sand casting. Vehicle support base plate 580 has a proximal support base plate edge 580*s* and a distal support base plate edge 580*t*.

Figure 5:
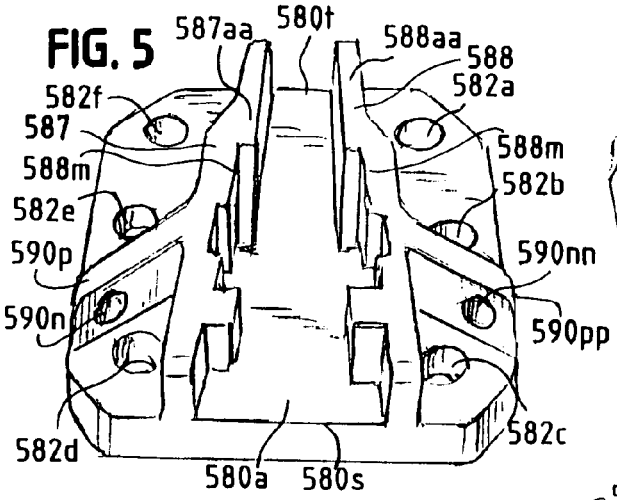
FIG. 5 illustrates an upper partial plan view of the vehicle support base plate.
Figure 7:
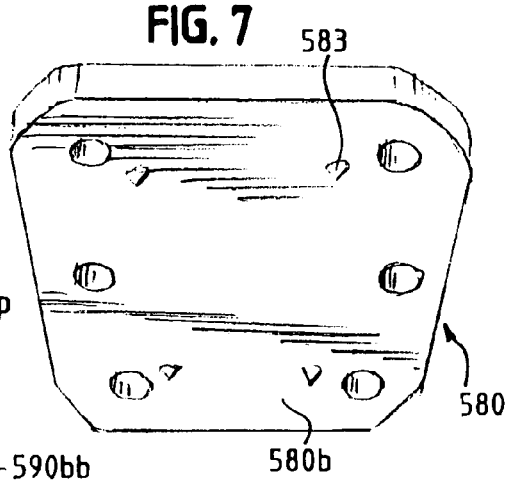
FIG. 7 illustrates a partial lower plan view of the vehicle support base plate.

Referring now to FIGS. 5 and 7, vehicle support base plate 580 preferably comprises a square metal plate with rounded edges. However, other shapes are also within the scope of my invention. Support base plate 580 is preferably approximately eleven inches in length and width, and one-half inch in thickness. Vehicle support base plate 580 has an upper base plate surface 580*a* and a lower base plate surface 580*b*. Vehicle support base plate 580 also comprises two triplets of base plate round openings 582*a*, 582*b*, 582*c*, and 582*d*, 582*e*, 582*f* (generically base plate round openings 582).

As seen in FIG. 2, base plate round openings 582 reversibly receive immobilization stakes 787 to drive into a supporting surface 8, thereby immobilizing support base plate 580. Each immobilization stake 787 is approximately 12 inches in length and approximately ¾ inch in diameter. Each immobilization stake 787 is cylindrical but tapers to a point and has a capped upper end. Prior art immobilization stakes 787 are available from BeerCoastGuard.com. As seen in FIG. 7, lower base plate surface 580*b* comprises small protruding studs 583. Small protruding studs 583 are driven into the ground or other supporting surface 8 for additional immobilization.

Figure 6:
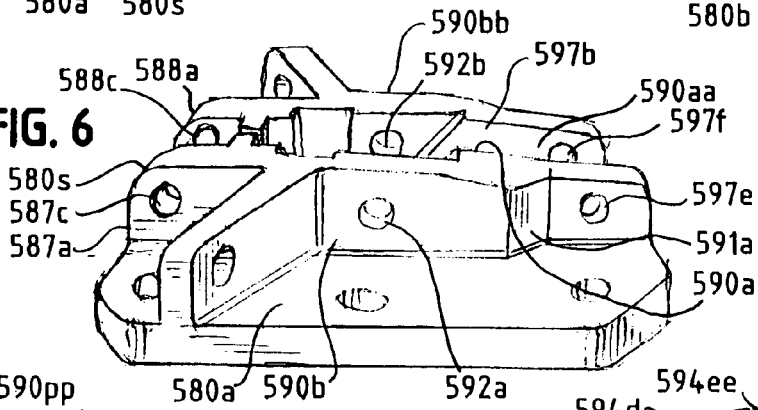
FIG. 6 illustrates a partial lateral view of the vehicle support base plate.
Figure 8A:
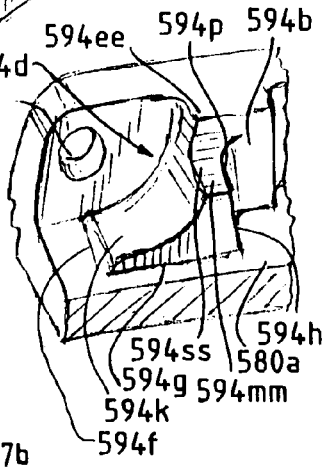
FIG. 8A illustrates a detailed isolated view of a protuberance along an elevated base plate wall as indicated in FIG. 8.
Figure 8:
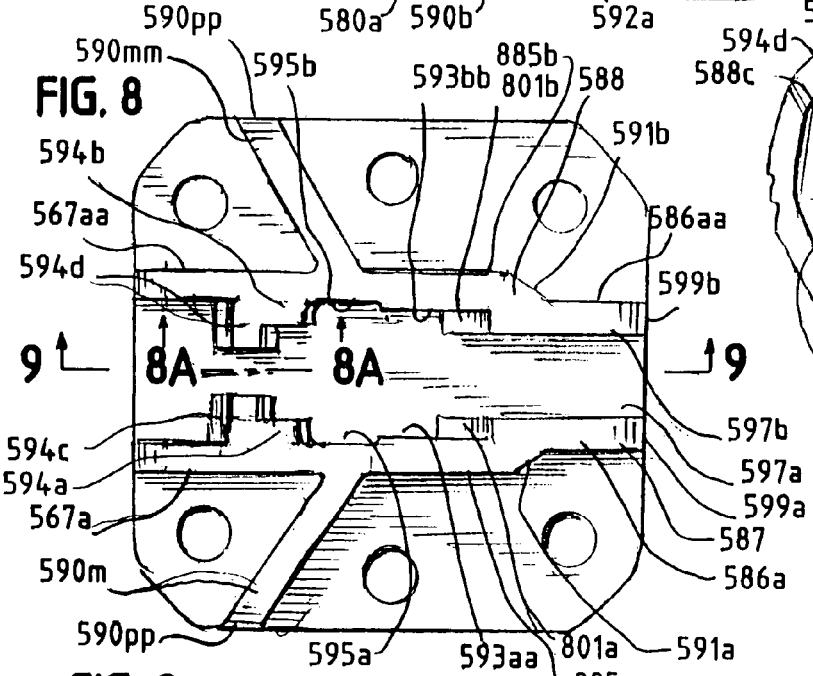
FIG. 8 illustrates an upper plan view of the vehicle support base plate.

Referring now to FIGS. 5, 6, and 8 base plate upper surface 580*a* comprises opposing first and second elevated base plate walls 587, 588 respectively. Each elevated base plate wall 587, 588 is an integral part of supporting base plate 580. Each elevated base plate wall 587, 588 is structurally identical to the other, so the following discussion designates the same features on each elevated wall 587, 588. Each elevated base plate wall 587, 588 is preferably approximately eleven inches in length and one and three-quarters inches in height at each elevated base plate wall midpoint 587*m*, 588*m*. Elevated base plate walls 587,588 are parallel to each other, and each elevated base plate wall 587,588 protrudes upward at a right angle from upper base plate surface 580*a*.

Figure 18:
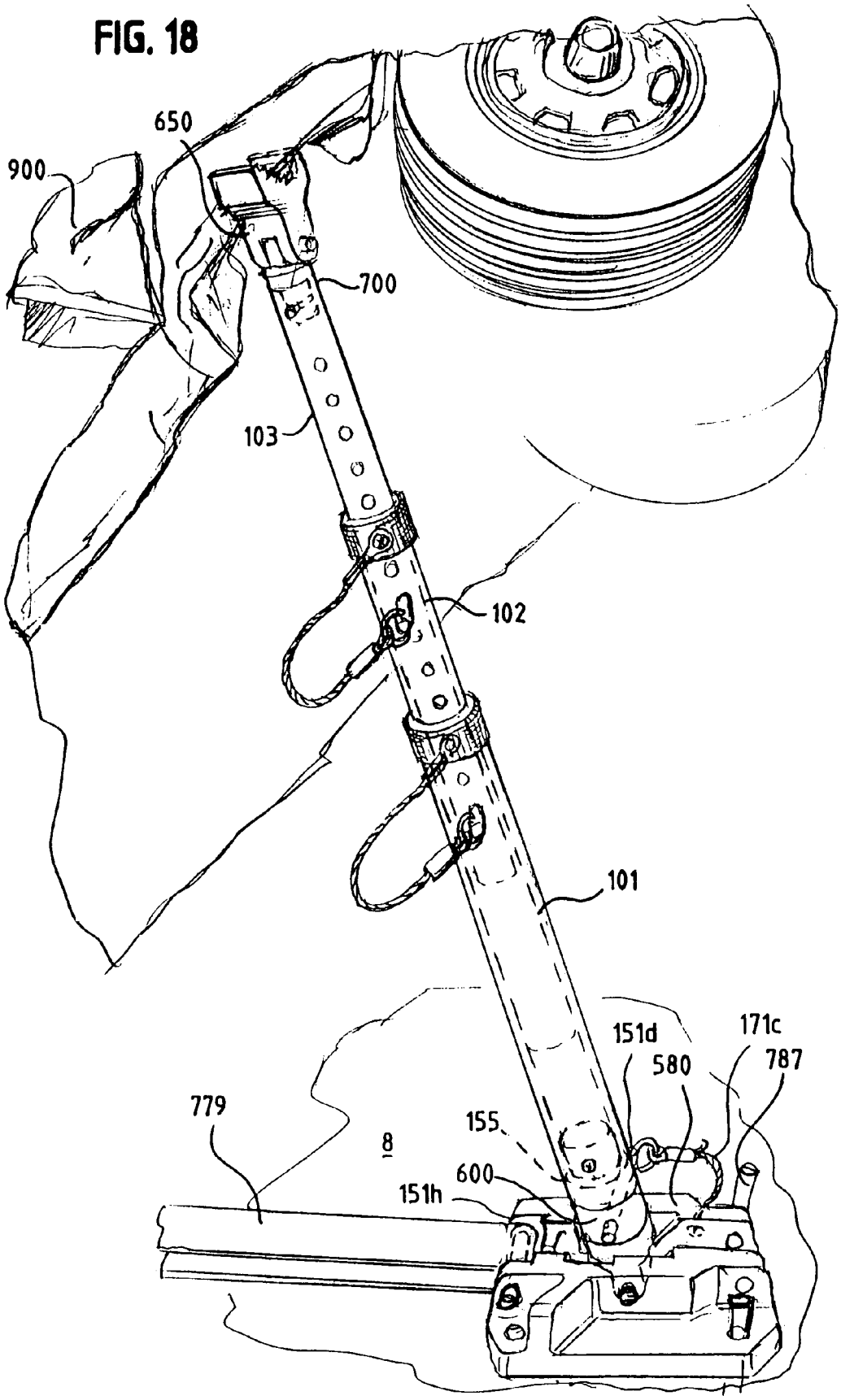
FIG. 18 illustrates my improved emergency vehicle support kit propping a vehicle and assisted by a ratcheting strap attached to the vehicle base plate support plate.

Referring now to FIG. 6, each elevated base plate wall 587, 588 comprises a proximal first aperture end 587*a* and a proximal second aperture end 588*a*. Each proximal aperture end 587*a*, 588*a* comprises a corresponding first and second strap aperture 587*c*, 588*c* respectively. Strap apertures 587*c*, 588*c* are parallel with each other. Referring to FIG. 18, eighth straight metal detent ring pin with compressible bead 151*h* inserts simultaneously through both strap apertures 587*c*, 588*c*. Opposing first and second strap apertures 587*c*, 588*c* respectively are each approximately five-eighths inch in diameter. Each strap aperture 587*c*, 588*c* respectively is approximately one-quarter inch from proximal base plate end 580*s* at their respective most proximal points.

As seen in FIG. 18, attached ratcheting strap 779 attaches to seventh straight metal detent ring pin with compressible bead 151*g* to vehicle 900. Sixth immobilizing straight metal detent ring pin with compressible bead 151*f* attaches to vehicle base plate surface 580*a* by metal lanyard 171*c*. Metal lanyard 171*c* encircles round head metal screw 581*a* which inserts through vehicle support base plate 580. Please see FIG. 1.

As seen in FIG. 18, vehicle 900 and support base plate 580 are thereby stabilized in a manner well known in the industry. Eighth straight metal ring pin with compressible bead 151*h* attaches to chain or ratcheting strap 779, with or without a hook or s-shaped metal connector. Chain or ratcheting strap 779 resists force from vehicle 900 or building wall upon vehicle support base plate 580 which causes skidding.

Referring now to FIG. 6 of the preferred embodiment, first and second elevated base plate wall 587, 588 respectively each have a corresponding (i) interior elevated base plate wall surface 590*a*, 590*aa* respectively; and (ii) exterior elevated base plate wall surface 590*b*, 590*bb* respectively.

Each elevated base plate wall 587,588 also comprises a circular midpoint aperture 592*a*, 592*b*. Circular midpoint apertures 592*a*, 592*b* respectively each completely penetrate each corresponding elevated base plate wall 587,588 respectively.

Along Interior Elevated Base Plate Wall Surfaces 590*a*, 590*aa*

Referring now to FIGS. 6 and 8, continuously adjacent with and distal to proximal base plate end 580*s* along each interior elevated base plate wall surface 590*a*, 590*aa* are corresponding proximal first aperture end 587*a* and proximal second aperture end 588*a*. Each proximal aperture end 587*a*, 588*a* comprises a corresponding first and second strap aperture 587*c*, 588*c* respectively. Strap apertures 587*c*, 588*c* are aligned with and parallel to each other. Consequently, when eighth straight metal detent ring pin with compressible bead 151*h* inserts through both strap apertures 587*c*, 588*c*, ratcheting strap 779 attaches to detent pin 785 and vehicle 900, as discussed supra.

Still referring to FIG. 8, immediately distal to and continuous with, proximal first and second aperture ends 587*a*, 588*a* respectively, are first and second interior perpendicular extending wall segments 594*a*, 594*b* respectively. Each interior perpendicular extending wall segment 594*a*, 594*b* is approximately: one and one-half inches in longitudinal length; and seven-eighths inch in thickness. Interior perpendicular extending wall segments 594*a*, 594*b* are parallel to each other.

Referring now to FIGS. 8 and 8A, each first and second interior perpendicular extending wall segment 594*a*, 594*b* respectively forms first and second continuous interior sloping protuberances 594*c*, 594*d* respectively. Each interior sloping protuberance 594*c*, 594*d* is approximately:

(i) one and three-quarters inches in height at tallest point 594*e*, 594*ee* along each elevated base plate walls 587,588; and (ii) one inch in depth at each proximal protuberance side 594*ff*, 594*f* along upper vehicle support base plate surface 580*a*; and (iii) one and one-half inches in length at each protuberance longitudinal side 594*gg*, 594*g* along upper vehicle support base plate surface 580*a*; and (iv) one-half inch in depth of distal protuberance side 594*hh*, 594*h* along upper vehicle support base plate surface 580*a*.

Each continuous interior sloping protuberance 594*c*, 594*d* is continuous with and integral to, each corresponding interior perpendicular extending wall segment 594*a*, 594*b*. Each protuberance 594*c*, 594*d* forms a C-shaped curve thickness 594*k*. Each C-shaped curve thickness 594*k* extends along upper vehicle support base plate 580*a*, and each C-shaved curve thickness 594*k* terminates immediately below corresponding first and second strap apertures 587*c*, 588*c* respectively. Each C-shaped curve thickness 594*k* also asymptotically slopes to (i) vehicle support base plate upper surface 580*a*, and (ii) simultaneously towards proximal protuberance sides 594*f*, 594*ff* respectively.

Still referring to FIG. 8, each continuous interior sloping protuberance 594*c*,594*d* integrally protrudes at each corresponding interior perpendicular extending wall segment 594*a*, 594*b* respectively. Referring to FIG. 8A, each first and second continuous interior sloping protuberance 594*c*, 594*d* respectively forms first and second sloping small ridges 594*m*,594*mm*. Sloping small ridges 594*m*, 594*mm* are approximately perpendicular to upper vehicle support base plate surface 580*a* and are approximately five-eighths inch in width at each corresponding sloping small ridge midpoint 594*s*,594*ss* respectively.

Each continuous interior sloping protuberance 594*c*, 594*d* is aligned and parallel to the other. Each protuberance 594*c*, 594*d* functions as a partial housing for ratcheting strap 789, and protuberances 594*c*, 594*d* also function as a device for "capturing" swivel base plate adapter 600, infra.

Figure 9:
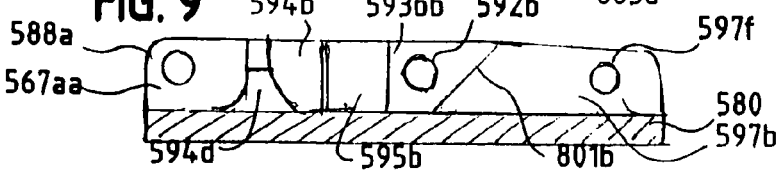
FIG. 9 illustrates a cross-sectional view of a vehicle support base plate of FIG. 1 through view lines 9-9.

Referring now to FIGS. 8 and 9, immediately distal to and continuous with first and second interior perpendicular extending wall segments 594*a*, 594*b* are first and second interior indented square wall segments 595*a*, 595*b* respectively. Each indented square wall segment 595*a*, 595*b* is approximately one and three-quarters inches in distal/proximal longitudinal length along upper vehicle support base plate surface 580*a*; and one-half inch in thickness through corresponding elevated base plate walls 587, 588 respectively. At each indented interior square wall segment 595*a*, 595*b*, elevated base plate walls 587,588 are separated from each other by approximately four inches. Each interior square wall segment 595*a*, 595*b* is parallel to and aligned with the other.

Still referring to FIGS. 6, 8 and 9, immediately distal to and continuous with, each indented square wall segment 595*a*, 595*b* respectively are corresponding first and second interior quadrilateral wall segments 593*aa*, 593*bb* respectively. Each interior quadrilateral wall segment 593*aa*, 594*bb* contains first and second circular mid-line apertures 592*a*, 592*b* respectively. Each mid-line aperture 592*a*, 592*b* aligns with the other, so seventh straight metal detent ring pin with compressible bead 151*h* easily inserts through both apertures 592*a*, 592*b* simultaneously.

Each elevated base plate wall 587, 588 respectively is approximately one-half inch in thickness through each interior quadrilateral surface segment 593*aa*, 593*bb* respectively. Each segment 593*aa*, 593*bb* also has the same height as corresponding elevated base plate wall 587, 588 respectively. Each interior quadrilateral wall segment 593*aa* is parallel to and aligns with opposing quadrilateral wall segment 593*bb*.

Still referring to FIGS. 6, 8 and 9, continuous with and immediately distal to first and second interior quadrilateral segments 593*aa*, 593*bb* respectively are corresponding first and second interior slanted wall segments 801*a*, 801*b* respectively. Each interior slanted wall segment 801*a*, 801*b* slopes downward from its respective elevated base plate wall 587 588, to vehicle support base plate upper surface 580*a*. Each slanted interior wall segment 801*a*, 801*b* integrally and continuously attaches to each interior elevated wall surface 590*a*, 590*aa* respectively. Each interior slanted wall segment 801*a*, 801*b* is also a surface upon which swivel vehicle base plate adapter 600 rotates, infra.

Each interior slanted wall segment 801*a*, 801*b* is parallel to and aligned with the other. Each interior slanted wall segment 801*a*, 801*b* respectively is approximately three-quarters inch in thickness, in addition to each respective one-half inch elevated base plate wall thickness at the maximum height of each segment 801*a*, 801*b* (i.e, top of elevated base plate wall 587, 588). Each interior slanted extending wall segment 801*a*, 801*b* is approximately two and one-half inches in maximum height at the top of elevated base plate wall 587, 588. Each interior slanted wall segment 801*a*, 801*b* also forms an approximate 50 degree angle with upper vehicle support base plate surface 580*a*.

Still referring to FIGS. 6 and 8, immediately distal to, and continuous with, each interior slanted wall segment 801*a*, 801*b* are corresponding first and second four sided interior wall segments 597*a*, 597*b* respectively. Preferably, each four sided interior wall segment 597*a*, 597*b* is trapezoidal with its lowest edge continuous with and along vehicle support upper base plate surface 580*a*. First and second four sided interior wall segments 597*a*, 597*b* are parallel and aligned with each other along each respective elevated base plate wall 587, 588.

The height of each interior four sided wall segment 597*a*, 597*b* is greatest where each segment 597*a*, 597*b* meets the top of each elevated base plate wall 587, 588, i.e., approximately one and one-quarter inches. Each interior four sided wall segment 597*a*, 597*b* is approximately one and three-eighths inches in thickness at its junction with interior slanted wall segment 801*a*, 801*b*, and five inches in thickness above each distal end aperture 597*e*, 597*f*, infra. The length of each interior four sided wall segment 597*a*, 597*b* is approximately five inches along upper vehicle support base plate surface 580*a*; and three and one-quarter inches along the top of each elevated base plate wall 587, 588.

Referring to FIG. 6, each interior four sided interior surface 597*a*, 597*b* comprises first and second distal elevated wall apertures 597*e*, 597*f* respectively. Distal elevated apertures 597*e*, 597*f* align so a straight metal detent ring pin with compressible bead inserts within distal elevated apertures 597*e*, 597*f* simultaneously.

Referring to FIGS. 6, 8 and 9, each first and second interior four sided wall segment 597*a*, 597*b* respectively is continuous with each corresponding first and second distal perpendicular surfaces 599*a*, 599*b* respectively. Each distal perpendicular surface 599*a*, 599*b* slants at an angle of approximately 10 degrees to vehicle support base plate upper surface 580*a*. Distal perpendicular surfaces 599*a*, 599*b* are parallel to each other.

Along Exterior Elevated Base Plate Walls 590*b*, 590*bb*

Referring now to FIGS. 5, 6, and 8 first and second exterior elevated base plate wall surfaces 590*b*, 590*bb* respectively comprise exterior rectangular longitudinal surfaces 567*a*, 567*aa* at proximal support base plate edge 580*s*. Each exterior rectangular longitudinal surface 567*a*, 567*aa* is approximately three and one-half inches in length along upper vehicle support plate surface 580*a* and parallel elevated base plate wall upper edge 598*a*, 598*aa* as the case may be. Each exterior rectangular longitudinal surface 567*a*, 567*aa* is approximately one and three-quarters inches in height. Exterior rectangular longitudinal surface 567*a*,567*aa* each comprise an exterior opening of each corresponding proximal strap aperture 587*c*, 588*c* respectively, supra.

Continuous with each exterior rectangular longitudinal surface 567*a*, 567*aa* and distal to each interior perpendicular wall segment 594*a*, 594*b* respectively are corresponding first and second extending elevated base plate wall arms 590*m*, 590*mm* respectively. Each extending elevated base plate arm 590*m*, 590*mm* is integral with, and perpendicular to, upper base plate surface 580*a*. Each extending elevated base plate arm 590*m*, 590*mm* extends from elevated base plate wall exterior surface 590*b*, 590*bb* at an angle of approximately 60 to 70 degrees, and towards proximal elevated base plate edge 580*s*.

Each extending elevated base plate arm 590*m*, 590*mm* is approximately three and one-quarter inches in length; one-half inch in thickness; and one and three-quarters inches in height. As seen in FIG. 5, each extending elevated base plate arm 590*m*, 590*mm* respectively comprises a first and second outer arm aperture 590*n*, 590*nn* respectively. Each outer arm aperture 590*n*, 590*nn* respectively is approximately five-eighths inch in diameter and approximately one-quarter inch from each arm outermost end 590*p*, 590*pp* respectively.

A second and third arm ratcheting strap 779 drawn through each outer arm aperture 590*n*, 590*nn* respectively can attach vehicle support base plate 580 to two additional points along a crashed motor vehicle or weakened building. In this manner, there are two or three attachments to the building or vehicle which further stabilize the vehicle support base plate 580 and prevent it from sliding along support surface 8.

Referring to FIGS. 5, 6, 8 and 9, immediately distal to and continuous with, first and second extending elevated base plate arms 590*m*, 590*mm* are first and second exterior middle longitudinal surfaces 885*a*, 885*b*. Each exterior middle longitudinal surface 885*a*, 885*b* is approximately three and one-quarter inches in length along the top surface of elevated base plate walls 587,588 respectively. Each exterior middle longitudinal surface 885*a*, 885*b* is approximately one and three-quarters inches in height.

As seen in FIG. 6, each exterior middle longitudinal surface 885*a*, 885*b* contains the external opening of one corresponding circular mid-line aperture 592*a*, 592*b*. Circular mid-line apertures 592*a*, 592*b* align with each other, so sixth straight metal detent ring pin with compressible bead 151*f* inserts simultaneously through apertures 592*a*, 592*b* and channel 592*c* within swivel base plate adapter 600, infra.

Still referring to FIGS. 5, 6, 8 and 9, immediately distal to and continuous with, each first and second exterior middle longitudinal surface 885*a*, 885*b* respectively are first and second exterior angled base plate surfaces 591*a*, 591*b* respectively. Each exterior angled base plate surface 591*a*, 591*b* is approximately one inch in longitudinal length along vehicle support base plate upper surface 580*a* and the tops of elevated base plate walls 587, 588. Each exterior angled base plate surface 591*a*, 591*b* is approximately one and one-half inches in height at its distal side; and one and three-quarters inches in height at its proximal side. Exterior angled base plate surfaces 591*a*, 591*b* each form an angle of approximately 65 degrees with exterior middle longitudinal surfaces 885*a*, 885*b* respectively.

Continuous with and immediately distal to first and second exterior angled base plate surfaces 590*a*, 590*aa* respectively are first and second exterior distal end surfaces 586*a*, 586*aa* respectively. Each exterior distal end surface 586*a*, 586*aa* is approximately one and three-quarters inches in longitudinal length along vehicle support base plate upper surface 580*a*; and one and three-quarters inches in length along top elevated base plate wall edges 587*a*, 588*aa*. Each exterior distal end surface 586*a*, 586*aa* is approximately one and one-quarter inches in height at its distal side and one and one-half inches at its proximal side.

Each exterior distal end surface 586*a*, 586*aa* contains exterior opening of corresponding first and second distal end apertures 597*e*, 597*f*. Distal end apertures 597*e*, 597*f* align with each other so a straight metal detent ring pin with compressible bead inserts within both distal end apertures 597*e*, 597*f* simultaneously. Each exterior distal end also comprises strap apertures ends 599*a*, 599*b*, which are approximately perpendicular to surface 580*a*.

Swivel Vehicle Base Plate Adapter 600

Figure 10:
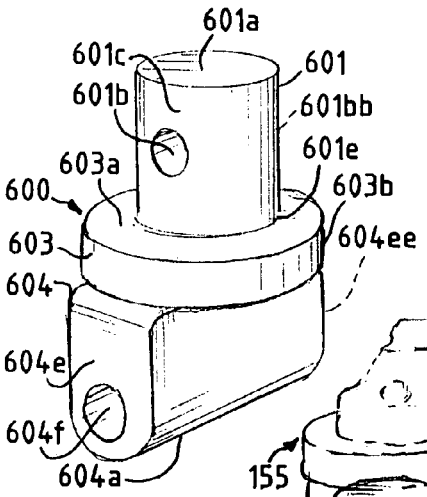
FIG. 10 illustrates a partial perspective view of a swivel base plate adapter.
Figure 11:
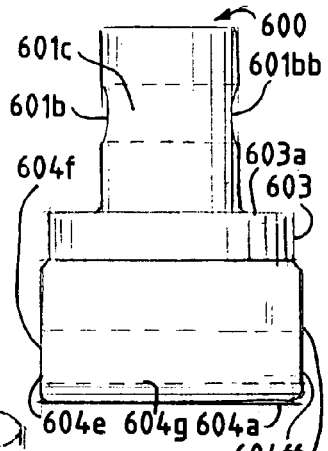
FIG. 11 illustrates a lateral view of the swivel base plate adapter of FIG. 10.

Referring now to FIGS. 10 and 11, swivel base plate adapter 600 is approximately four and three-fourths inches in total length. Swivel base plate adapter 600 comprises a short solid metal adapter cylindrical upper component 601, and component 601 is approximately one and seven-eighths inches in cylindrical height. Adapter cylindrical upper component 601 has a flat circular top 601*a* which is approximately two and one-quarter inches in diameter. Adapter cylindrical upper component 601 also comprises first and second swivel adapter upper apertures 601*b*, 601*bb* respectively. Swivel adapter upper apertures 601*b*, 601*bb* oppose each other along at approximately 180 degrees.

Still referring to FIGS. 10 and 11, Swivel adapter upper apertures 601*b*, 601*bb* are positioned approximately one inch from flat circular top 601*a*. Swivel adapter upper apertures 601*b*, 601*bb* comprise continuous swivel channel 601*c*. As seen in FIG. 14, when cylinder end plug 155 fits over swivel adapter 600, then cylinder end plug apertures 161*c*, 161*d*, congruently align with continuous swivel channel 601*c*. Third straight metal detent ring pin with compressible bead 151*c* then simultaneously inserts through cylinder end plug apertures 161*c*, 161*d* and swivel channel 601*c*. This insertion attaches cylinder 101 to upper swivel base component 601.

Swivel base plate adapter 600 also comprises adapter circular plate 603 and lower partially cylindrical component 604, infra. Adapter circular plate 603 is approximately one-half inch in thickness and integrally attaches to upper swivel base plate component lower surface 601*e*. Adapter circular plate 603 has an upper circular flat surface 603*a* which attaches to upper component lower surface 601*e*. Upper and lower circular flat surfaces 603*a*, 603*b* each have a diameter of approximately three and one-half inches.

Adapter circular plate 603 integrally attaches to lower partially cylindrical component 604 along lower circular flat surface 603*b*. Partially cylindrical component 604 comprises a rounded lower surface 604*a*. Rounded lower surface 604*a* is continuous with first and second opposing straight longitudinal sides 604*e*, 604*ee* respectively and lower circular flat surface 603*b*. Smooth opposing longitudinal sides 604*e*, 604*ee* are approximately perpendicular to rounded lower surface 604*a*.

Still referring to FIGS. 10, 11 and 14, lower partially cylindrical component 604 is approximately three and one-quarter inches in length parallel to lower circular plate flat surface 603*b*; two inches in height parallel to opposing straight longitudinal sides 604*e*, 604*ee*; and one and one-half inches in width at lowest rounded surface 604*a*. Each opposing straight longitudinal side 604*e*, 604*ee* comprises the first and second opposing exterior openings 604*f*, 604*ff* respectively, of continuous lower swivel channel 604*g*.

Sixth metal detent ring pin with compressible bead 151*f* inserts simultaneously inserts through lower swivel channel 604*g* and congruently aligned circular midpoint apertures 592*a*, 592*b*. When so inserted, sixth metal detent pin with compressible bead 151*f* attaches swivel base plate support adapter 600 to elevated base plate walls 587, 588. Sixth metal detent ring pin with compressible bead 151*f* thereby forms the physical axis around which swivel support base plate adapter 600 rotates.

Swivel base plate adapter 600 does not contact interior elevated base plate wall surfaces 590*a*, 590*aa* when adapter 600 rotates around sixth metal detent ring pin with compressible bead 151*f* through an angle of approximately 140 degrees. Swivel base plate adapter 600 is stopped from further rotation by adapter circular plate 603 abutting (i) elevated base plate upper surface 580*a* proximally; or (ii) interior slanted wall segments 801*a*, 801*b* distally.

Figure 12:
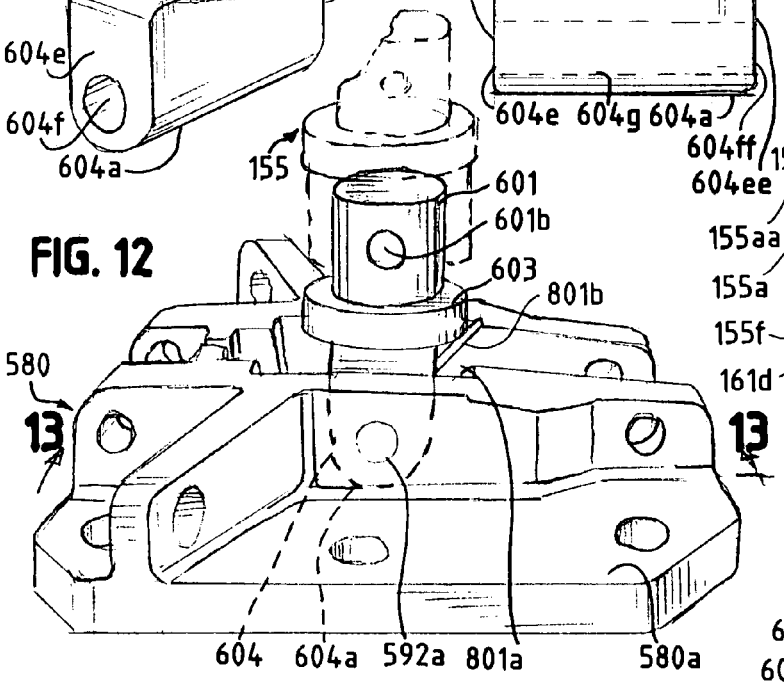
FIG. 12 illustrates a partial phantom lateral view of the swivel base plate adapter of FIG. 10 within a vehicle support base plate, and with a superimposed end-plug segment in phantom.
Figure 13:
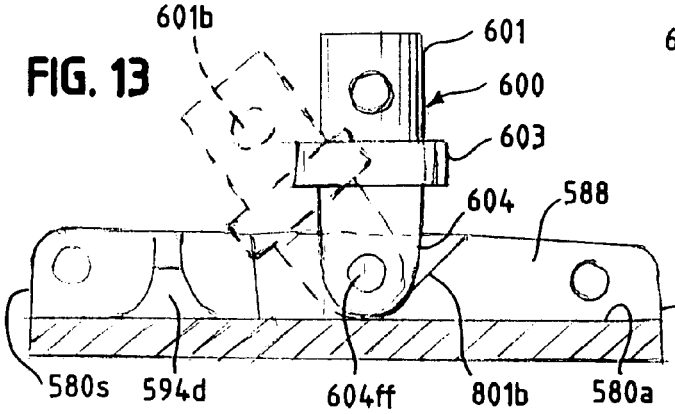
FIG. 13 illustrates a cross-sectional view of the swivel base plate adapter of FIG. 10 which inserts into the vehicle support base plate at an angle in phantom.
Figure 13:
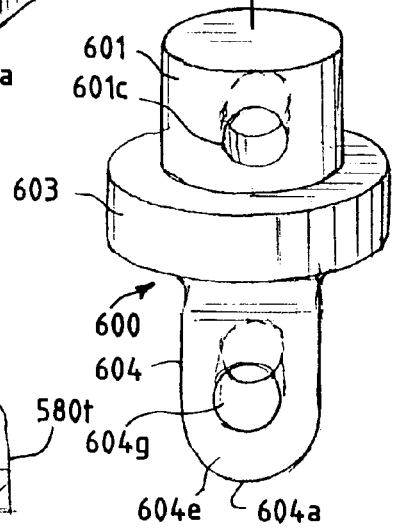

As seen in FIGS. 12, 13 and 18, vehicle support base plate 580 with attached vehicle swivel base plate adapter 600 can attach to cylinder end plug 155 at an angle to supporting surface 8.

Still referring to FIG. 18, after sixth straight metal detent ring pin with compressible bead 151*f* inserts through vehicle support base plate 580 and swivel base plate adapter 600 the operator tightens ratcheting strap 779 (which also attaches to vehicle 900 or a building). The weight of the unstable vehicle or building 900 stabilizes supporting base plate 580 through ratcheting strap 779 tied thereto, in a manner well known in this particular industry.

Operation

Referring again to FIG. 1, in the best mode and preferred embodiment of my invention, my improved emergency vehicle support kit 100 operates as follows:

(1) The operator confirms that initially collapsed telescoping device 104 contains first and second pistons 102, 103 within attached cylinder 101.

(2) He or she also confirms that:

(i) proximal cylinder end plug 155 is securely fastened within proximal cylinder end 104*a* by stainless steel button-head socket cap screws 160*a*, 160*b*; and (i) metal detent ring pins with compressible beads 151 are attached to knurled connector rings, knurled first piston connector ring 401, knurled cylinder connector ring 400, and vehicle support base plate 580 by appropriate metal lanyards 77 and screws.

(3) The operator then attaches swivel universal base plate adapter 600 to vehicle support base plate 580 with eighth metal detent ring pin with compressible bead 151*h*. The operator attaches proximal cylinder end plug 155 to swivel universal base plate adapter 600 by seventh metal detent ring pin with compressible bead 151*g*. This attachment connects still initially collapsed telescoping device 104 to swivel base plate adapter 600.

(4) The operator now manually extends first piston 102 (and second piston 103 if necessary) from within cylinder 101 until first distal piston end 102*b*, or second piston end 103*b* approach a potential stabilizing contact along the vehicle or collapsing building. If only first piston, or a portion thereof, is required for this pre-determined extension, then second piston 103 remains collapsed within first piston 102.

(5) Now the operator selects an appropriate attachment, such as conical attachment 660 or double-blade attachment 650 to universal attachment adapter 700, with sixth metal detent ring pin with compressible bead 151*f*.

(6) The operator also confirms that swivel support base plate adapter 600 is correctly angled within elevated base plate walls 587, 588. Then the operator attaches the ratcheting strap 789 from base plate 580 to vehicle 900 or building. This ratcheting between the base plate 580 and the structure thereby creates tension between the base plate 580 and the supported structure.

(7) The operator then releases manual grip upon telescoping device 104 and the vehicle 900 or a building. The weight of vehicle 900 or building immobilizes the telescoping device 104 into its angled or vertical position without further operator assistance.

(8) A tow truck, or other device for "flipping" vehicle 900, releases the force which was originally supported solely by telescoping device 104. The rescuer then loosens the ratchet and removes the straight metal detent pin with compressible bead 151 from which prevented the first piston 102 or second piston 103 from falling into the cylinder 101 and/or first piston 102.

Assembly

In the best mode and preferred embodiment of my invention, assembly of my improved emergency vehicle kit 100 proceeds as follows:

(1) The operator initially inserts lowermost proximal cylinder end plug 155 into proximal end 101*a* of cylinder 101. He or she attaches end plug 155 to cylinder 101 with first and second stainless steel button-head socket cap screws 160*a*, 160*b;*

(2) The operator next inserts proximal first piston end plug 156 into first piston proximal end 102*a*. He or she then attaches proximal first piston end plug 156 to first piston 102 with third and fourth stainless steel flat-head socket cap screws 163*a*, 163*b* respectively;

(3) He or she next inserts first piston 102 into the open distal cylinder end 101*b* until first piston 102 contacts cylindrical end plug 155 and therefore can insert no further;

(4) The operator now positions knurled cylinder ring 400 over distal first piston end 102*b*. He/she attaches knurled cylinder connector ring 400 to cylinder 101 with first and second knurled stainless steel flat-head socket cap screws 400*h*, 400*i* respectively;

(5) Next, the operator inserts second piston proximal end-plug 158 into second piston proximal end 103*a*. He or she attaches second piston proximal end-plug 158 to second piston 103 with first and second stainless steel flat-head socket cap screws 163*r*, 163*s* respectively;

(6) Second piston 103 is now inserted into distal first piston end 102*b* until it abuts proximal second piston end-plug 158 end and inserts no further;

(7) Knurled first piston circular ring 401 is positioned over distal second piston end 103*b*. The operator attaches knurled first piston circular ring 401 to distal first piston end 102*b* with first and second knurled stainless steel button-head cap screws 401*h*, 401*i* respectively.

(8) Now the operator inserts distal second piston end universal adapter 700 into distal second piston end 103*b*. He or she attaches universal adapter 700 to distal piston end 103*b* with first and second opposing ¼" stainless steel set screws 141,142 respectively.

(9) The operator now inserts swivel support base plate adapter 600 into proximal lowermost cylinder end 101*a*, and secures cylinder end 101*a* to swivel support base plate adapter 600 with metal detent ring pin with compressible bead 151*g*.

(10) The operator finally positions swivel support base plate adapter 600 within vehicle support base plate 580. He then inserts tethered detent ring pin with compressible bead 151*h* through support base plate 580 and swivel base plate adapter 600, thereby securing swivel base plate adapter 600 to vehicle support base plate 580.

Materials

In addition to structure and design features, the strength of materials comprising my improved emergency vehicle support kit 100 are crucial.

(1) The preferred metal pins are available from:

PivotPoint

P.O. Box 488

Hustisford, Wis. 53034

Straight metal detent ring pins with compressible bead (generically pins 151) have round "key rings" at the upper end of each pin to prevent slippage through piston apertures. The recommended models are:

(a) Most preferred: ⅝ inch by 3.5-inch detent ring pins with compressible beads and collars (12L14Carbon Steel Zinc w/yellow chromate finish or stainless steel), where ⅝ inch is the diameter of the pin shaft;

(b) Also satisfactory: ⅝ inch by four and ¾ inch ring pins with collars (Grade 5, 1144 carbon steel with zinc and yellow chromate finish).

Metal detent ring pins compressible beads 151 are preferably made of carbon steel or stainless steel.

(2) Aluminum sand casted components such as cylinder end plug 155, first piston end plug 156, second piston end plug 158, distal piston universal adapter 700, conical attachment 660, double-blade attachment 650, and piston knurled rings 400, 401 are custom made by:

Louis Meskan Foundry 2007-13 North Major Ave.

Chicago, Ill. 60639

These 356-T components are made by initially pouring molten metal into a mold and are designated in the industry as "sand castings."

(3) Aluminum extruded cylinders 101 and pistons 102, 103 are custom made by:

Precision Extrusions

720 East Green Street

Bensenville, Ill. 60106

The preferred material for cylinder 101 is aluminum type 6061-T6, which is extruded, and then dipped in cold water in a process well known in this particular industry.

(4) Swivel vehicle support base plate adapter 600 and vehicle support base plate 580 are also made by Meskan Foundry and consist of 356-T6 aluminum sand casting.

All changes within the meaning and range of equivalency of the claims, are intended to be included therein. The above discussion describes the preferred embodiment and the best mode. The detailed description of my improved emergency vehicle support kit in no manner limits the spirit or scope of additional accessories, which are compatible with the scope of my invention.

The invention claimed is:

1. An improved emergency vehicle support kit, said kit comprising:

(A) A cylinder, said cylinder comprising a continuous longitudinal wall, said cylinder having a longitudinal axis, said cylinder having a distal cylinder end and a proximal cylinder end, said cylinder having a cylinder diameter, said cylinder having a cylinder interior, (B) A first piston, said piston having a continuous piston longitudinal wall, said first piston having a proximal first piston end and a distal first piston end, said first piston having a first piston diameter which is narrower than said cylinder diameter, said first piston being connected to said distal cylinder end, said first piston having a cylindrical interior (C) An uppermost distal second piston, said uppermost distal second piston having a continuous second longitudinal wall, said second piston having a second proximal second piston end and a second distal second piston end, said second piston having a second piston cylinder interior, said cylinder, said first piston and said second piston comprising a telescoping device, said telescoping device further comprising attachments which grip a vehicle or building, (D) a vehicle support base plate, said vehicle support base plate comprising an upper base plate surface, said vehicle support base plate further comprising small protruding studs and base plate round openings, (E) a swivel base plate adapter, said swivel base plate adapter rotating through an angle of approximately 140 degrees, Whereby, said swivel base plate adapter connects to said proximal cylinder end, and said swivel base plate adapter simultaneously connects to said vehicle support base plate, said cylinder attached to said first piston proximal end, said second piston attached to said first piston distal end, said second piston capable of sliding within said first piston interior, said first piston capable of sliding within said cylinder, said telescoping device forming a rigid support for a vehicle or building, said first piston and said second piston comprising at least two sets of linearly aligned piston apertures, said first piston and said cylinder each comprising a knurled ring at their respective distal ends, said vehicle support base plate comprising a first outer arm aperture and a second outer arm aperture, said base plate further comprising a first strap aperture and second strap aperture.

2. An improved emergency vehicle support kit as described in claim 1 wherein said swivel base plate adapter comprises a bottom most rounded surface, said swivel base plate adapter comprising a lower swivel channel, said swivel base plate adapter attached to said base plate by a sixth detent pin, said sixth detent pin traversing said lower swivel channel.

3. An improved emergency vehicle kit as described in claim 2, wherein said vehicle support base plate further comprises midline apertures by which said swivel support base plate adapter attaches to said vehicle support base plate with a straight metal détente ring pin with a compressible bead.

4. An improved emergency vehicle support kit as described in claim 3, wherein said vehicle support kit comprising a cylinder end plug, said cylinder end plug comprising apertures for attaching said cylinder end plug to said swivel support base plate adapter, said cylinder end plug also comprising apertures for attach said cylinder end plug to said proximal cylinder end.

5. An improved emergency vehicle support kit as described in claim 4, wherein said vehicle support kit comprises aluminum sand castings.

6. An improved emergency vehicle support kit comprising:

(A) A cylinder, said cylinder comprising a continuous longitudinal wall, said cylinder having a longitudinal axis, said cylinder having a distal cylinder end and a proximal cylinder end, said cylinder having a cylinder diameter, said cylinder having a cylinder interior, (B) A first piston, said piston having a continuous piston longitudinal wall, said first piston having a proximal first piston end and a distal first piston end, said first piston having a first piston diameter which is narrower than said cylinder diameter, said first piston being connected to said distal cylinder end, said first piston having a cylindrical interior (C) An uppermost distal second piston, said uppermost distal second piston having a continuous second longitudinal wall, said second piston having a second proximal second piston end and a second distal second piston end, said second piston having a second piston cylinder interior, said cylinder, said first piston and said second piston comprising a telescoping device, said telescoping device further comprising attachments which grip a vehicle or building, (D) a vehicle support base plate, said vehicle support base plate comprising an upper base plate surface, (E) a swivel base plate adapter, said swivel base plate adapter rotating through an angle of approximately 140 degrees, Whereby, said swivel base plate adapter connects to said proximal cylinder end, and said swivel base plate adapter simultaneously connects to said vehicle support base plate, said cylinder attached to said first piston proximal end, said second piston attached to said first piston distal end, said second piston capable of sliding within said first piston interior, said first piston capable of sliding within said cylinder, said telescoping device forming a rigid support for a vehicle or building, said first piston and said second piston comprising at least two sets of linearly aligned piston apertures, said first piston and said cylinder each comprising a knurled ring at their respective distal ends, said vehicle support base plate comprising two elevated base plate walls, said elevated base plate walls each comprising one outwardly extending arm, said swivel base plate adapter comprising a bottom most rounded surface, said vehicle support base plate further comprises comprising midline apertures by which said swivel support base plate adapter attaches to said vehicle support base plate with a straight metal detent pin with a compressible bead, said vehicle support kit comprising a cylinder end plug, said cylinder end plug comprising apertures for attaching said cylinder end plug to said swivel support base plate adapter, said cylinder end plug also comprising apertures for attaching said cylinder end plug to said proximal cylinder end, said vehicle support kit comprising aluminum sand castings, said vehicle support kit comprising extruded aluminum.

7. An improved emergency vehicle support kit, said kit comprising:

(A) A telescoping device, said telescoping device comprising a lowermost proximal cylinder, a first piston and a second piston, said second piston comprising an uppermost distal second piston end, (B) A vehicle support base plate, said base plate comprising (1) a first and a second opposing elevated base plate wall, each said base plate wall comprising (a) apertures for insertion of a metal detent ring pin with a compressible bead, (b) an interior wall surface and an exterior wall surface, each said interior wall surface comprising (i) an opposing perpendicular extending segment, said perpendicular extending segment further comprising one protuberance, (ii) an interior indented square segment, said interior indented square segment continuous with and distal to said opposing perpendicular extending segment, (iii) a longitudinal rectangular segment, each said longitudinal rectangular segment being continuous with and distal to said corresponding interior indented square segment, (iv) an interior slanted wall segment, said interior slanted wall segments distal to and continuous with said longitudinal rectangular segment, (v) a distal base plate aperture end, said distal base plate aperture end comprising a distal aperture, said distal base plate aperture end being continuous with and distal to said interior slanted wall segment, each said exterior base plate wall surface comprising (i) a proximal base plate aperture end, said proximal base plate aperture end comprising a proximal strap aperture, (ii) an extending base plate arm, said extending base plate arm comprising an outermost end, said outermost end comprising an outermost aperture, said extending base plate arm continuous with and distal to said proximal base plate aperture end, (iii) an exterior rectangular base plate surface, said exterior rectangular base plate surface comprising said mid-line aperture, said exterior rectangular base plate surface continuous with and immediately distal to said extending base plate arm, (iv) an exterior angled base plate surface, said exterior angled base plate surface slanted toward the interior mid-line of said vehicle support base (v) plate at an angle of approximately 130 degrees, said exterior angled base plate surface continuous with and immediately distal to said exterior rectangular base plate surface, (v) a distal base plate aperture segment, said distal base plate aperture segment comprising said distal base plate aperture, (D) a swivel base plate adapter, and (E) attachments, said attachments connecting to said uppermost distal piston end.

8. The improved emergency vehicle support kit as described in claim 7 wherein (A) said cylinder comprises a proximal metal cylinder end plug and said distal cylinder end comprising a cylinder knurled metal ring, (B) said first piston comprising a proximal first piston metal end plug and a distal first piston knurled metal ring, (C) said first piston collapsing into said cylinder with a narrow longitudinal space remaining between said cylinder wall and said collapsed first piston wall, said second piston collapsing into said first piston with a narrow longitudinal space remaining between said first piston wall and said collapsed second piston wall.

9. The improved emergency vehicle support kit as described in claim 8 wherein said swivel base plate adapter comprises a partially cylindrical lowermost end and smooth longitudinal sides, said smooth longitudinal sides each comprising one detent pin aperture, said partially cylindrical lowermost end rotating upon said upper vehicle support plate surface and said interior slanted base plate wall segments.

10. The improved emergency vehicle support kit as described in claim 9 wherein said swivel base plate adapter comprises an upper solid metal cylindrical component, said upper solid metal cylindrical component comprising first and second opposing uppermost swivel apertures, said swivel base plate adapter further comprising a solid metal ring plate, said solid metal ring plate integrally positioned between said upper swivel base plate component and said lower swivel base plate component.

* * * * *